US009968518B2

(12) United States Patent
Hammond et al.

(10) Patent No.: US 9,968,518 B2
(45) Date of Patent: May 15, 2018

(54) PACKAGING

(71) Applicant: Multi Packaging Solutions UK Limited, Nottingham (GB)

(72) Inventors: Carol Lynn Hammond, Nottingham (GB); Nigel Davis, Nottingham (GB)

(73) Assignee: Multi Packaging Solutions UK Limited, Nottingham (GB)

( * ) Notice: Subject to any disclaimer, the term of this patent is extended or adjusted under 35 U.S.C. 154(b) by 38 days.

(21) Appl. No.: 14/919,352

(22) Filed: Oct. 21, 2015

(65) Prior Publication Data

US 2016/0122102 A1 May 5, 2016

(30) Foreign Application Priority Data

Nov. 3, 2014 (GB) ..... 1419578.8
Sep. 7, 2015 (GB) ..... 1515808.2

(51) Int. Cl.
*B65D 75/36* (2006.01)
*A61J 1/03* (2006.01)
(Continued)

(52) U.S. Cl.
CPC ..... *A61J 1/035* (2013.01); *B65D 5/38* (2013.01); *B65D 75/327* (2013.01); *B65D 75/36* (2013.01); *B65D 75/367* (2013.01); *B65D 77/0413* (2013.01); *B65D 77/30* (2013.01); *B65D 83/0463* (2013.01); *B65D 2075/361* (2013.01); *B65D 2575/362* (2013.01)

(58) Field of Classification Search
CPC ..... A61J 1/035; B65D 5/38; B65D 75/327; B65D 75/36; B65D 75/367; B65D 77/0463; B65D 2075/361; B65D 2575/362
USPC ..... 206/1.5, 531, 532, 538, 539; 229/125.125
See application file for complete search history.

(56) References Cited

U.S. PATENT DOCUMENTS 3,568,827 A 3/1971 Haring et al.
4,007,828 A * 2/1977 Mayled ..... B65D 11/12 206/1.5

(Continued)

FOREIGN PATENT DOCUMENTS

GB 2490524 A 11/2012
WO WO2015164210 A1 10/2015

OTHER PUBLICATIONS

UK search report for GB1515808.2 dated Mar. 21, 2016.
EP search report for EP155190874.6 dated Feb. 10, 2016.

*Primary Examiner* — Chun Cheung
(74) *Attorney, Agent, or Firm* — O'Shea Getz P.C.

(57) ABSTRACT

A package includes a container having an open end and a closed end, and a slider slidably mounted within the container. A releasable locking feature is provided at a side of the package, which comprises a pair of locking edges, one associated with a sidewall of each of the slider and container respectively, and a release area for releasing a locking abutment between the locking edges. The release area is provided in the sidewall of the container having the locking edge, and the locking edge of the slider comprises two or more plies of a material used to provide the slider. The package includes means for biasing the locking edge of the slider into engagement with the locking edge of the container. The biasing means extends from a blister pack carrier connected to the slider.

14 Claims, 13 Drawing Sheets

(51) Int. Cl.

| | |
|---|---|
| ***B65D 75/32*** | (2006.01) |
| ***B65D 5/38*** | (2006.01) |
| ***B65D 83/04*** | (2006.01) |
| ***B65D 77/04*** | (2006.01) |
| ***B65D 77/30*** | (2006.01) |

(56) References Cited

U.S. PATENT DOCUMENTS 6,230,893 B1 * 5/2001 Karow ..... B65D 5/38 206/1.5
6,491,211 B1 12/2002 Evans et al.
7,389,875 B2 * 6/2008 Sandberg ..... B65D 5/38 206/1.5
7,708,142 B2 5/2010 Ehrlund
7,967,144 B2 * 6/2011 Sack ..... B65D 83/0463 206/538
8,011,512 B2 * 9/2011 Brollier ..... A61J 1/035 206/1.5
2007/0181458 A1 * 8/2007 Ehrlund ..... B65D 5/38 206/528
2007/0235367 A1 * 10/2007 Initini ..... A61J 1/035 206/531
2009/0184022 A1 7/2009 Coe et al.
2011/0067363 A1 3/2011 Sprada et al.
2011/0108451 A1 * 5/2011 Sack ..... B65D 83/0463 206/531
2011/0215022 A1 * 9/2011 Sack ..... B65D 83/04 206/531
2012/0234701 A1 9/2012 Albrecht et al.
2015/0307246 A1 * 10/2015 Patwardhan ..... B65D 55/02 206/1.5
2016/0001937 A1 * 1/2016 Skinner ..... B65D 50/046 206/1.5

* cited by examiner

PACKAGING

This application is entitled to the benefit of, and incorporates by reference essential subject matter disclosed in United Kingdom Application No. 1419578.8 filed on Nov. 3, 2014 and United Kingdom Application No. 1515808.2 filed Sep. 7, 2015.

BACKGROUND OF THE INVENTION

1. Technical Field

The present invention relates to child resistant packaging. The present invention is, in particular, although not exclusively, directed to packaging for pharmaceutical products. The packaging is made of a foldable sheet material, such as cardboard, paperboard, or the like. The present invention seeks to provide an improved child-resistant safety package.

2. Background Information

The Applicant has realized that there is a need for improved safety packaging that prevents, or at least makes more difficult, the dispensing of the contents of the packaging by children.

SUMMARY OF THE INVENTION

From a first aspect, therefore, the present invention therefore provides a package comprising: a container having an open end and a closed end, and comprising a pair of sidewalls, at least one facing panel connecting the sidewalls, and an end wall; a slider for holding a product, the slider being slidably mounted within the container and comprising at least one sidewall and at least one facing panel; wherein the package comprises at least one releasable locking feature at a side of the package, the releasable locking feature comprising a pair of locking edges, one associated with a sidewall of each of the slider and container respectively, and a release area for releasing a locking abutment between the locking edges, the release area being provided in the sidewall of the container having the locking edge, wherein the locking edge of the slider comprises two or more plies of a material used to provide the slider; wherein the locking edges cooperate to prevent movement of the slider out of the open end of the container for permitting access to the product until a user manually applies pressure to the release area to deform the release area and thereby deflect the locking edge of the slider out of abutment with the locking edge of the container to permit the slider to slide past the locking edge of the container.

The locking edge of the slider is provided by two or more plies of a material used to provide the slider. This may provide a more reliable locking edge, which may cooperate with the locking edge of the container to provide effective locking, even after multiple cycles of sliding the slider into and out of the container. In particularly preferred embodiments, the slider is made from a blank of foldable sheet material, and the locking edge is provided by two or more plies of the foldable sheet material. The plies may be adhered to one another. The blank of foldable sheet material may be a one piece blank of foldable sheet material. While the edge may comprise more than two plies of material, it is preferred that the edge is formed from only two plies of the material. This may facilitate manufacture, and avoids using excessive quantities of material.

A two ply locking edge may be provided by adding an additional separate piece to a sidewall panel of the slider e.g. attaching a separate piece to the inner or outer surface of a sidewall panel that is connected to the facing panel of the slider e.g. along a foldline. However, the locking edge is preferably provided by folding a material of the slider to provide the two or more plies thereof. In some embodiments the sidewall comprises a first panel and a second panel connected thereto along a foldline, and which second panel is folded back over the first panel to provide a multi-ply sidewall terminating in the locking edge. Each panel may be defined by a single thickness of a material of the slider. In preferred embodiments the entire sidewall having the locking edge may comprise the two or more plies of material. At least the at least one facing panel, and optionally the entire remainder of the slider is single ply. Preferably the other sidewall (if provided), and where provided, end wall of the slider are single ply.

The slider has at least one sidewall and at least one facing panel connected to a sidewall or sidewalls of the slider. Preferably each facing panel is connected to the or each sidewall. The slider has at least the sidewall which provides the locking edge. The slider may comprise a single facing panel or a pair of facing panels. The slider may include only a single sidewall. In some preferred embodiments the slider comprises a pair of sidewalls connected by the at least one facing panel, and preferably by a single facing panel. The or each sidewall is preferably attached to the facing panel or panels of the slider along a respective foldline or foldlines.

The slider is slidably mounted with respect to the container. This enables the slider to be slid out of the container to provide access to a product held by the slider when the releasable locking feature is released. The slider may hold the product in an interior space thereof. The slider may be slidably mounted with respect to the container to enable the slider to be moved between a first position relative to the container, in which the slider is located at least partially within the container for preventing access to a product held by the slider, and a second position relative to the container in which at least a portion of the slider extends out of the open end of the container for permitting access to the product, wherein the releasable locking feature selectively prevents movement of the slider relative to the container from the first position to the second position. The releasable locking feature will prevent movement of the slider relative to the container from the first position to the second position until a user manually applies pressure to the release area of the locking feature. Preferably the first position is a position in which the slider is located fully within the container. The releasable locking feature may be the only means for preventing the slider from sliding from the first position relative to the container to the second position.

The package preferably comprises only one said releasable locking feature comprising a pair of locking edges associated with respective sidewalls of the slider and container, and a release area therefor on the sidewall of the container. The releasable locking feature is associated with a side of the package in that the pair of locking edges and the release area therefor are associated with sidewalls of the slider and container at a side of the package.

It will be appreciated that the "releasable locking feature" may be referred to as a "locking feature" herein for brevity, and a reference to a "locking feature" herein should be understood interchangeably with the term "releasable locking feature" unless the context demands otherwise.

Deformation of the release area results in the edge of the slider that cooperates with the locking edge of the container to prevent the slider being moved out of the open end of the container being deflected out of abutment with the locking edge of the container to permit the slider to slide past the locking edge. The release area acts on a portion of the sidewall of the slider providing the locking edge to deflect the edge of the slider out of abutment with the locking edge of the container.

It will be appreciated that in accordance with the invention in any of its aspects or embodiments, the slider has a first end that is closest to the end wall of the container i.e. the closed end thereof, and an opposite second end. The closed end of the container may be referred to as the bottom end thereof, and the open end the top end thereof. The first end of the slider may therefore be referred to as a bottom end of the slider, and the second end of the slider the top end thereof. The second end of the slider may be defined by a top edge of the facing panel(s) of the slider, and optionally by an end wall. Regardless of the relative positions of the slider and the container, the first end of the slider will remain closest to the end wall of the container (although the distance between the end of the slider and the end wall of the container will vary as the slider slides into or out of the container). As used herein, the term "upper" refers to a position closer to the top open end of the container (or the second end of the slider), and the term "lower" refers to a position closer to the bottom closed end of the container (or the first end of the slider).

The releasable locking feature comprises a locking edge of the slider which cooperates with the locking edge of the container. Preferably the edge extends across the entire width of the sidewall of the slider. Preferably the sidewall of the slider having the locking edge terminates in the locking edge. Thus the locking edge is provided by a transverse end edge of the sidewall. The locking edge of the slider may be a transversely extending end edge of the sidewall closest to the second end of the slider. The edge may be a straight edge. The locking edge may extend perpendicular to a foldline connecting the sidewall to the or a facing panel of the slider.

In embodiments the sidewall of the slider providing the locking edge terminates at a point spaced from the second end of the slider. Each sidewall of the slider (where a pair of sidewalls are provided) may be of the same length i.e. terminating at the same point relative to the second end of the slider.

Preferably, where the slider comprises a pair of sidewalls, only one of the sidewalls of the slider defines a locking edge. Preferably the other sidewall is a single ply sidewall. The package therefore preferably comprises a releasable locking feature associated with only one side thereof i.e. of the container/slider.

Preferably the slider comprises a single facing panel and one or a pair of sidewalls upstanding therefrom. The or each sidewall of the slider may cooperate with the sidewalls of the container to guide the slider as it slides relative to the container. The or each sidewall may act as a runner for the slider.

The slider may comprise an end wall at the second end thereof. The end wall may close the open end of the container when the slider is located therein to provide a closed package. In some preferred embodiments the or each sidewall of the slider terminates at a position spaced from the end wall of the slider, and at least one flap is connected to a respective side edge of the end wall along a respective foldline, and is folded so as to extend toward the end of the sidewall of the slider on the respective side thereof over at least a portion of the distance between the end of the sidewall and the end wall of the slider. Preferably the or each flap terminates at a point spaced from an end of the sidewall on the respective side of the slider. Preferably the slider comprises a pair of sidewalls, and a pair of such flaps are provided, one on each respective side of the slider. It has been found that such flaps may help to stabilize the end wall of the slider when the slider is disposed in the container in a storage configuration, and inhibit outward rolling of the end wall relative to the open end of the container. This may help to prevent access of a product held in the slider.

As will be described above, the release area may interact with at least a portion of the sidewall of the slider to deflect the locking edge out of abutment with the locking edge of the container. The portion may be a portion adjacent the locking edge of the slider.

The or each facing panel of the slider may be of any desired shape. In some embodiments in which the slider comprises at least one sidewall having a transverse end edge closest to the second end of the slider that is spaced therefrom, the or each facing panel is necked in the region between the second end of the slider and the end of the sidewall.

The locking edge of the slider may be located at any point along the length of the slider. The locking edge is preferably located closer to the second end of the slider than the first end. The locking edge may be located less than 40% or less than 30% along the length of the slider from the second end thereof. The locking edge is preferably spaced from the second end of the slider. The locking edge may be located at least 10% or at least 15% along the length of the slider from the second end thereof. However, these ranges are merely exemplary, and the most suitable dimensions will depend upon the size and configuration of a particular container and package, and its content.

The container may be of any suitable form. Preferably the container comprises a pair of opposed facing panels connecting the pair of sidewalls thereof.

The locking edge of the container engages the locking edge of the slider to prevent movement of the slider out of the container as described herein. The locking edge of the container is provided on the sidewall of the container having the release area.

The locking edge of the container is a transversely extending edge. The locking edge may extend across the entire width of the sidewall of the container. The locking edge may extend perpendicular to a foldline connecting the sidewall to the facing panel. The locking edge of the container is provided on the sidewall of the container having the release area. The locking edge may extend inwardly from the interior of a sidewall panel for cooperating with the locking edge of the slider. The locking edge may be provided in any suitable manner e.g. by joining an additional component to a portion of the interior of the sidewall of the container, or by varying a thickness of the sidewall etc. In some embodiments the locking edge is provided by the edge of a glue flap joined to an interior of the sidewall. The glue flap may be joined to the interior of a top flap of the sidewall panel. In embodiments in which the container comprises a pair of facing panels, the glue flap is connected along a foldline to a facing panel of the container opposite a facing panel to which the top flap is connected along a foidline. The top flap may be defined by a transverse cutline in the sidewall panel. Preferably the cutline extends into a facing panel of the container to which the top flap is connected along a foldline.

The releasable locking feature comprises a release area. The release area may be provided in any suitable location on the sidewall of the container. The release area may or may not be specifically defined i.e. by a structural feature or features of the sidewall and/or by a graphical indication of the position of the release area. In some embodiments, it is envisaged that, depending e.g. upon the stiffness of the material providing the sidewall of the container, the user may be able to deform the sidewall to deflect the locking edge of the slider without needing to provide specific structural features to define the release area, or facilitate its deformation. Whether or not the release area is specifically defined by structural features, the container e.g. the sidewall thereof may be provided with a marking or instruction to a user as to the location of a release area and/or how to release the locking abutment e.g. "push here".

Where a defined release area is provided, the defined release area may be of any desired size. Preferably the release area is sized appropriately to enable pressure to be exerted thereon by a finger tip. A defined release area corresponds to only a portion of the area of the sidewall. The release area preferably extends across the entire width of the sidewall.

Defining the release area using at least one cutline may facilitate deformation of the release area to release the locking abutment. In preferred embodiments the container comprises at least one cutline in the sidewall of the container that defines the release area. A single cutline may be provided defining one edge e.g. a top edge of the release area. The cutline may define a top flap of a sidewall panel as described above. In some preferred embodiments the release area is defined between first and second cutlines in a sidewall of the container. The cutlines are spaced from one another along the length of the sidewall. The cutlines may provide a more precisely defined release area. One of the cutlines may define a top flap of a sidewall panel as described above.

A cutline as referred to herein may comprise one or more cuts. In some embodiments any one, or each, of the cutlines of the pair of cutlines may comprise a line of perforations. A cutline will then comprise a plurality of cuts, adjacent cuts being separated by a web of material. A cutline comprising a line of perforations may comprise two or more cuts. In embodiments in which a cutline comprises a line of perforations, the perforations will be broken by a user upon first use of the package when pressure is applied to the release area of the container to create a continuous cutline. In preferred embodiments a or preferably each cutline where multiple cutlines are provided is a non-perforated cutline. The cutline may then be defined by a single continuous cut. A cutline may be defined between cut edges of adjacent components of the sidewall. The or each cutline is preferably a straight line. However, it is envisaged that the or each cutline may be curved, whether concavely or convexly. This may provide a rounded release area. Where first and second cutlines are provided, the cutlines preferably extend parallel to one another. Preferably the or each cutline extends perpendicular to a foldline connecting the sidewall to a facing panel of the container. Preferably the or each cutline extends into a facing panel of the container. However, this is only a preferred feature to facilitate operation of the release area. A cutline or cutlines may optionally be provided in an opposed facing panel of the container to provide a continuation of the cutline or cutlines.

The package of the present invention in any of its aspects or embodiments may comprise any desired additional features.

In preferred embodiments the package comprises a retaining feature for preventing complete separation of the slider from the container. The retaining feature may comprise respective parts of the container and slider which interact with one another to prevent complete separation of the slider from the container. The cooperating parts may be provided at the open (top) end of the container and the first (bottom) end of the slider respectively. The parts may be respective flaps provided one on each of the container and slider. The respective flaps of the slider and container may be connected to the slider and container along foldlines. The flaps are hingedly connected to the container and slider respectively. Preferably the container part of the retaining feature comprises a flap provided at the open top end of the container. The flap may extend from the open top end of the container and be folded back toward the closed bottom end. The flap may extend from an edge of one of the facing panels of the container. The slider part of the retaining feature e.g. a cooperating flap of the slider may comprise a flap at the first (bottom) end of the slider. The flap may extend from the first, bottom end of the slider and be folded back toward the second, top end.

In embodiments in which the container part of the retaining feature comprises a flap extending from an edge of a facing panel of the container, the opposite facing panel of the container to that having the flap may be connected along a foldline to a flap at the top open end of the container which is folded back toward the closed bottom end. This flap may be secured to an interior surface of the facing panel e.g. using adhesive to reinforce the top end of the facing panel.

One or both of the facing panels of the container may comprise a notch to facilitate gripping of the slider when located within the container for withdrawing the slider from the container. The notch may be provided on the edge of the facing panel which defines the open end of the container. Preferably a pair of notches, and most preferably matching notches, is provided, one on each of the respective ones of the facing panels. The notch may be of any suitable shape e.g. semi-circular. In preferred embodiments one or both of the facing panels of the container comprises a set of one or more segments which may be removed from the container by a user to define a notch in the panel to facilitate gripping of the slider when located in the container for withdrawing the slider from the container. Each segment may be connected to the facing panel by a line of weakness e.g. perforations. Each set of one or more segments may define a notch of any of the types discussed above, and in any of the locations mentioned. Each segment may be of any desired shape. Each segment may be of any suitable shape. The notch is preferably on an edge of the facing panel which defines the open end of the container. Preferably a pair of sets of one or more removable segments are provided for respectively defining a pair of notches, e.g. matching notches, one on each of the respective ones of the facing panels. Each set of one or more removable segments defines a notch. These embodiments in which a notch is defined by a user removing one or more segments from a facing panel are advantageous in that this provides an additional level of child resistance before the child can grip the end of the slider through the notch when located in the container.

Where the top end of a facing panel is connected to a flap e.g. to provide a retaining feature or to reinforce the top end of the facing panel, the notch should extend through the flap to enable a user to grip the end of the slider when located in the container. Where the notch is defined by removing a set of one or more segments from the facing panel, the or each segment may extend into the flap for defining the notch therein, or a set of one or more additional removable segments may be provided in the flap. In some embodiments a single removable segment extends across the foldline between a facing panel and a flap connected thereto, which segment may be removed to define a notch extending through the facing panel and flap.

In accordance with the invention in any of its aspects or embodiments, the slider is configured to hold a product. The slider may comprise any suitable container for the product, with the configuration depending upon the product to be held. The invention extends to the package in accordance with the invention in any of its aspects or embodiments comprising the product. In some preferred embodiments the product is in the form of a blister pack. Blister packs are well known, particularly for pharmaceutical products. The pack comprises one or more "blisters" which hold capsules, tablets or other items, and whose face is sealed by a foil or other film. The blister contents are dispensed by the user pressing down on the blister, thereby pushing the contents out through the sealing film.

While a blister pack may be held directly by the slider, in preferred embodiments the package comprises a carrier for the blister pack, and the slider is configured to hold the blister pack carrier. The carrier for the blister pack may be integral with the slider, or may be a separate component joined thereto. Preferably the blister pack carrier e.g. a panel thereof is connected to the slider along a foldline. The blister pack carrier may be hingedly connected to the slider. In some preferred embodiments the carrier for the blister pack is defined by part of a blank, which blank also defines the slider. The blank is preferably a single piece blank.

The blister pack carrier may be attached to any wall or edge of the slider. The blister pack carrier may be attached to an end or side edge of the slider. Preferably the blister pack carrier is connected to the slider at the second end of the slider. The blister pack carrier may be connected to the slider at an end opposite to an end having a flap forming part of a retaining means for preventing compete separation of the slider from the container. In some preferred embodiments a panel of the blister pack carrier is connected to an end wall of the slider along a foldine at a first edge of the end wall. The end wall of the slider may be connected to a facing panel of the slider by a foldline at an opposed second edge of the end wall. The first and second edges of the end wall are connected by side edges of the end wall.

It has been found that the use of at least one flap extending from an end wall of the slider to stabilize the end wall, and prevent rollout as discussed above, is particularly advantageous when the slider comprises a blister pack carrier connected thereto (whether integral with the slider or not). This may help to prevent access to the blisters by rolling the end wall outwardly. In embodiments comprising such a flap or flaps, preferably the end wall is connected to the facing panel along a foldline at a first edge of the end wall, and is connected to a panel of a blister pack carrier along a foldline at an opposite second edge of the end wall, the first and second edges of the end wall being connected by the side edges of the end wall.

From a further aspect of the invention there is provided; a slider configured to be slidably mounted within a container and comprising at least one sidewall, at least one facing panel, and an end wall, wherein the end wall is connected to the facing panel at a first edge of the end wall, and is connected to a panel of a blister pack carrier at an opposite second edge of the end wall, the first and second edges of the end wall being connected by side edges of the end wall; wherein the at least one sidewall of the slider terminates at a position spaced from the end wall of the slider; and wherein the slider comprises at least one flap connected to a respective side edge of the end wall along a foldline, the or each said flap being folded toward an end of the sidewall on its respective side of the slider and extending over at least a portion of the distance between the end of the sidewall and the end wall of the slider.

The invention extends to a container having the slider of this further aspect slidably mounted therein. The container may have an open end and a closed end, and comprise a pair of sidewalls, at least one (and preferably a pair of) facing panel connecting the sidewalls and an end wall. The container may be in accordance with any of the embodiments previously described. The at least one flap is hingedly connected to the end wall along a respective foldline.

Preferably the slider comprises a pair of sidewalls, each sidewall terminating at a position spaced from the end wall of the slider, and a pair of flaps are connected to respective ones of the side edges of the end wall along respective foldlines, each flap being folded towards an end of the sidewall on its respective side of the slider and extending over at least a portion of the distance between the end of the sidewall and the end wall of the slider.

Preferably the end wall of the slider is connected to the facing panel along a foldline at a first edge of the end wall, and is connected to a panel of a blister pack carrier along a foldline at an opposite second edge of the end wall.

The present invention in accordance with any of its further aspects or embodiments may include any of the features described in reference to other aspects or embodiments of the invention to the extent it is not mutually inconsistent therewith.

Preferably the or each flap terminates at a point spaced from an end of the sidewall on the respective side of the slider.

In these aspects and embodiments of the invention, preferably the blister pack comprises only one layer of blisters. In these arrangements the rollover problem is particularly significant, as there is no additional adjacent layer of blisters with which the blisters can interlock to prevent movement of the blister pack carrier and inhibit the roll out problem.

In accordance with the invention in any of its aspects or embodiments, the blister pack carrier may be formed as a single panel, simply supporting the blister pack. However, in preferred embodiments the blister pack carrier comprises first and second panels, the blister pack being located between the first and second panels. The first and second panels may be secured to one another to retain the blister pack therebetween. The blister pack carrier preferably comprises a first panel having one or more opening for receiving a blister of the blister pack and a second panel having one or more dispensing openings aligned with said first panel opening. Preferably the carrier comprises a first panel having an opening for movably receiving a blister of said blister pack and a second panel having one or more dispensing openings aligned with said first panel opening, the first panel and the second panel slidably receiving the blister pack therebetween. The first and second panels may be connected to one another along a foldline. The first and second panels may be connected to one another in an end to end or side by side configuration. Where the blister pack carrier is connected to the slider, either of the first and second panels may be connected thereto along a foldline.

In accordance with any of the aspects or embodiments of the invention including a blister pack carrier, the blister pack carrier may provide an additional level of child resistance. The first and second panels of the blister pack carrier may be secured to one another to retain the blister pack therebetween in a manner permitting movement e.g. slidable movement of the blister pack relative to the carrier to permit a blister to be moved into alignment with a said dispensing opening for dispensing the blister's contents. In some preferred embodiments the carrier comprises a first panel having an opening for movably receiving a blister of said blister pack and a second panel having one or more dispensing openings aligned with said first panel opening, the first panel and the second panel slidably receiving the blister pack therebetween; and a blocking member selectively moveable between a blocking position and a dispensing position, said blocking member in its blocking position preventing movement of said blister in said first panel opening into alignment with a said dispensing opening, thereby preventing dispensing of the blister's contents through the dispensing opening, and in said dispensing position permitting said blister to be moved into alignment with said dispensing opening for dispensing the blister's contents.

Thus in accordance with these preferred embodiments of the invention, before dispensing a capsule etc. from a blister, the blocking member must first be moved to a dispensing position to allow the blister to be moved into alignment with a dispensing opening. This will at least make it more difficult for a child to dispense the blister's contents.

The blister pack carrier having such a blocking member may be in accordance with any of the embodiments described in GB 2451850A.

In accordance with any of the embodiments of the invention including a blocking member, the blocking member is preferably sandwiched between the first and second panels of the blister pack carrier.

The blocking member may be formed integrally with the blister pack carrier or may be a separate member mounted therein. For example, the blocking member may be attached to one of the blister pack carrier panels about a fold line, or may be a separate piece inserted between the blister pack carrier panels.

The blocking member has a part, e.g. an edge, which, in the blocking position, cooperates with the blister pack to prevent its movement. The blocking member may be a tab. The tab may be generally triangular or trapezoidal in shape, with its wider end adjacent an end of the blister pack carrier. The end is preferably an end of the carrier at which the first and second panels are connected to one another about a fold line. The end is preferably an end opposite to an end at which the blister pack carrier is connected to the slider. The blocking member, or at least the portion thereof having the blocking part, may be located centrally between the side edges of the blister pack carrier. In some embodiments the blocking member is a blocking tab which is pushed out of the plane of the package to allow the blister pack to move. The first or second panel may then be formed with a tab portion which is generally aligned with a blocking tab of the blocking member and which is depressible along with the blocking tab so as to allow the blister pack to slide up over an external surface of the tab portion. The other of the first panel or second panel is preferably provided with one or more cuts or lines of weakness which allow the tab to be pushed through that panel.

In other embodiments, the blocking member is slidably mounted between the first and second panels of the blister pack carrier. The blocking member may be selectively slidably retractable from between the first and second panels in order to permit the blister pack to move in the package. To this end, an edge of the blocking member may comprise one or more recesses which, when the blocking member is retracted, align with the blister to allow the blister pack to move. Preferably stop means are provided to prevent the blocking member from being fully retracted from the carrier. In one embodiment, the blocking member is generally T-shaped, with stop members being provided adjacent opposed edges of the lower limb of the blocking member.

The opening for receiving a blister of the blister pack in the first panel in any of the embodiments in which the blister pack carrier includes first and second panels, whether or not a blocking member is provided or the carrier is configured to movably receive a blister pack, may be of any suitable form, and may be configured to enable a single blister to pass therethrough. In any of the embodiments in which the blister pack is configured to be movable between first and second panels of the blister pack carrier, whether or not a blocking member is provided, preferably the or each opening of the first panel is an elongate slot. This allows the slot to closely receive and guide the blister of the blister pack. The opening or slot within the first panel may be long enough to accommodate a strip of multiple blisters. However, in preferred embodiments it is only sufficiently long to accommodate a single blister. In these embodiments, each blister has its individual opening. It has been found that such arrangements enhance child resistance, as a shorter opening e.g. slot reduces the ability of a child to try to remove the blister pack through the first panel of the blister pack carrier. As most blister packs are formed with a plurality of rows of blisters, in some embodiments of the invention, a plurality of parallel slots are provided in the first panel, and a plurality of aligned rows of dispensing openings provided in the second panel. In preferred embodiments in which each opening in the first panel is of a length to accommodate only a single blister, an array of openings is preferably provided in the first panel e.g. an arrangement of openings in columns and rows. An array of a plurality of aligned dispensing openings may then be provided in the second panel. Of course, the opening or slot in the first panel may be long enough to accommodate multiple blisters but shorter than required to accommodate an entire strip of blisters.

Preferably the blister pack is mounted for sliding movement along a straight line relative to the carrier. Preferably, therefore, the first panel slot or slots is or are straight. The first panel slot may be configured so to align a blister with the relevant dispensing opening when the or an end-most blister in a blister row is located against one end of the slot. In some embodiments, therefore, the end of the slot may be arcuate for engagement with an arcuate blister. However, this is not essential, and it may in fact be desirable to require the blister to be aligned manually with the dispensing opening, thereby making it even more difficult for a child to dispense the contents.

The or each dispensing opening of the second panel, in any or the embodiments in which the carrier includes first and second panels, whether or not the blister pack carrier is configured to movably receive a blister pack or includes a blocking member, is preferably provided with a removable cover. This provides enhanced child resistance, as the child may be prevented from seeing the blister pack until the cover is removed. The cover may be defined by one or more line of weakness e.g. perforations around the opening. In some preferred embodiments each removable cover is defined by a plurality of removable segments, such as a pair of segments. For example, each segment may be in the shape of a semi-circle or ellipse. However, the segments may be of any suitable shape, depending upon the shape of the dispensing opening to be defined, and in turn, upon the shape of the content of the blister pack. The use of segmented covers may provide an additional level of child resistance, with the child needing to remove multiple segments to provide a dispensing opening. The second panel is preferably provided with a plurality of dispensing openings corresponding in number to the number of blisters provided in the blister pack. In embodiments in which the blister pack is moved to a dispensing position e.g. where a blocking member is provided, one or other of the blisters will be in alignment with a dispensing opening.

Where the blister pack is arranged to be movable between the first and second panels of the blister pack, one or more flaps may be provided along the edge of one or other of the first and second panels in order to space the panels from one another when folded face to face to facilitate movement of the blister pack within the package.

In accordance with the invention in any of its aspects or embodiments, preferably the package comprises means for biasing the locking edge of the slider into engagement with the locking edge of the container. It will be appreciated that the use of a biasing means for biasing the locking edge of the slider into engagement with the locking edge of the container is advantageous in its own right, and may be used in conjunction with other arrangements, not necessarily having the double ply locking edge on a slider.

In accordance with a further aspect of the invention there is provided a package comprising: a container having an open end and a closed end, and comprising a pair of sidewalls, at least one facing panel connecting the sidewalls, and an end wall; a slider for holding a product, the slider being slidably mounted within the container and comprising at least one sidewall and at least one facing panel; wherein the package comprises at least one releasable locking feature at a side of the package, the releasable locking feature comprising a pair of locking edges, one associated with a sidewall of each of the slider and container respectively, and a release area for releasing a locking abutment between the locking edges, the release area being provided in the sidewall of the container having the locking edge; wherein the locking edges cooperate to prevent movement of the slider out of the open end of the container for permitting access to the product until a user manually applies pressure to the release area to deform the release area and thereby deflect the locking edge of the slider out of abutment with the locking edge of the container to permit the slider to slide past the locking edge of the container; and wherein the package comprises means for biasing the locking edge of the slider into engagement with the locking edge of the container.

The present invention in accordance with this further aspect may include any of the features described in reference to other aspects or embodiments of the invention to the extent it is not mutually inconsistent therewith.

In accordance with these further aspects or embodiments of the invention, the biasing means may result in more secure lock being obtained. The biasing means may act upon the sidewall of the slider having the locking edge to bias the sidewall outwardly toward the sidewall of the container. The biasing means may comprise a projection e.g. lug. In preferred embodiments the projection includes two plies. Preferably the projection is a two ply projection. The projection may define a sloping edge which engages the sidewall of the slider. Preferably the biasing means is provided by a single projection.

The biasing means should be located as appropriate to be able to bias the locking edge of the slider into engagement with the locking edge of the container. The biasing means may be located between the first and second ends of the slider, and preferably closer to the second end thereof.

As in the earlier aspects and embodiments of the invention, the slider is preferably configured to hold a product in the form of a blister pack. Preferably the package comprises a carrier for the blister pack. In preferred embodiments a blister pack carrier is connected to the slider e.g. along a foldline. This may be achieved in accordance with any of the earlier described embodiments. The blister pack carrier is disposed within the interior space of the slider when in a storage configuration in use e.g. within a tray defined by the at least one facing panel and at least one sidewall of the slider. Preferably the biasing means is provided on the blister pack carrier. In preferred embodiments in which the biasing means comprises a projection e.g. lug, the projection projects from a side edge of the blister pack carrier. The side edge of the blister pack carrier is a side edge which is adjacent the sidewall of the slider. The side edge of the blister pack carrier is a longitudinal side edge extending between the first and second ends of the slider respectively. The blister pack carrier may be of any of the configurations described above. The projection may project from a side edge of one or more panels of the blister pack carrier e.g. the first and/or panel thereof as described above. In some embodiments the projection is a two ply projection, with the plies being provided by formations extending from each of the first and second panels of the blister pack carrier respectively. The biasing means is preferably integrally formed with the blister pack carrier, and may additionally be integrally formed with the slider e.g. forming part of a blank that defines the slider and the blister pack carrier.

In accordance with the invention in any of its aspects or embodiments, any one or ones of the panels or walls of the container, slider or blister pack carrier may be formed from a single component, or may be defined by multiple components. Thus a panel may include a plurality of sub panels.

Preferably the facing panels of the container or slider are single component panels.

The slider and container, and where provided, the blister pack carrier, are each made from a foldable sheet material such as cardboard, paperboard or other lightweight foldable sheet material. However, any suitable sheet material may be used, for example a plastics material. The container and slider, and, where applicable, blister pack carrier, may each comprise any suitable arrangement of construction flaps or other means to retain the respective parts in their dimensional states.

The slider and container may each be made from a number of separate parts assembled together in an appropriate manner. Preferably the slider and the container are each constructed from a respective blank of material. Each blank is preferably a single piece blank.

The present invention extends to a blank of foldable sheet material for making the slider of a package in accordance with the invention in any of its aspects or embodiments, preferably wherein the blank is a single piece blank. In preferred embodiments the blank for providing the slider additionally comprises a portion for providing a blister pack carrier to be received by the slider. Thus, the slider and blister pack carrier are then provided from a single blank. The portion for providing the blister pack carrier may comprise biasing means for biasing the locking edge of the slider into engagement with the locking edge of the container. In preferred embodiments the portion for providing the blister pack carrier comprises one or more formations for defining a projection extending from the side edge of the blister pack carrier which provides the biasing means. Such formations may be associated with portions of the blank for providing first and second panels of the blister pack carrier, so as to provide a two ply projection. In accordance with any of the embodiments of the invention, whether or not biasing means is provided, preferably the portion for providing the blister pack carrier is integral with the portion for providing the slider. Preferably the blank is a single piece blank for providing the carrier and slider. Of course, in other arrangements it is envisaged that the blister pack carrier may be formed from a separate blank to the slider, and then attached to the slider. The present invention extends to a blank for making the container of a package in accordance with the invention in any of its aspects or embodiments, preferably wherein the blank is a single piece blank.

The present invention extends to a single piece blank of foldable sheet material for making a container in accordance with the invention in any of its aspects or embodiments, preferably wherein the blank is a single piece blank.

A fold line as referred to herein refers to any line about which components have been folded. The fold line may comprise a line of weakness, creaseline and/or perforations. If not explicitly stated, and unless inconsistent therewith, any connection described herein may be about a foldline.

The present invention in accordance with any of its further aspects or embodiments may include any of the features described in reference to other aspects or embodiments of the invention to the extent it is not mutually inconsistent therewith.

BRIEF DESCRIPTION OF THE DRAWINGS

Some preferred embodiments of the invention will now be described by way of example only with reference to the accompanying drawings, in which:

FIG. 9A illustrates an arrangement in which the slider of the package does not incorporate flaps 68, 70, and FIG. 9B illustrates an arrangement in which such flaps are provided.

DETAILED DESCRIPTION

Figure 1:
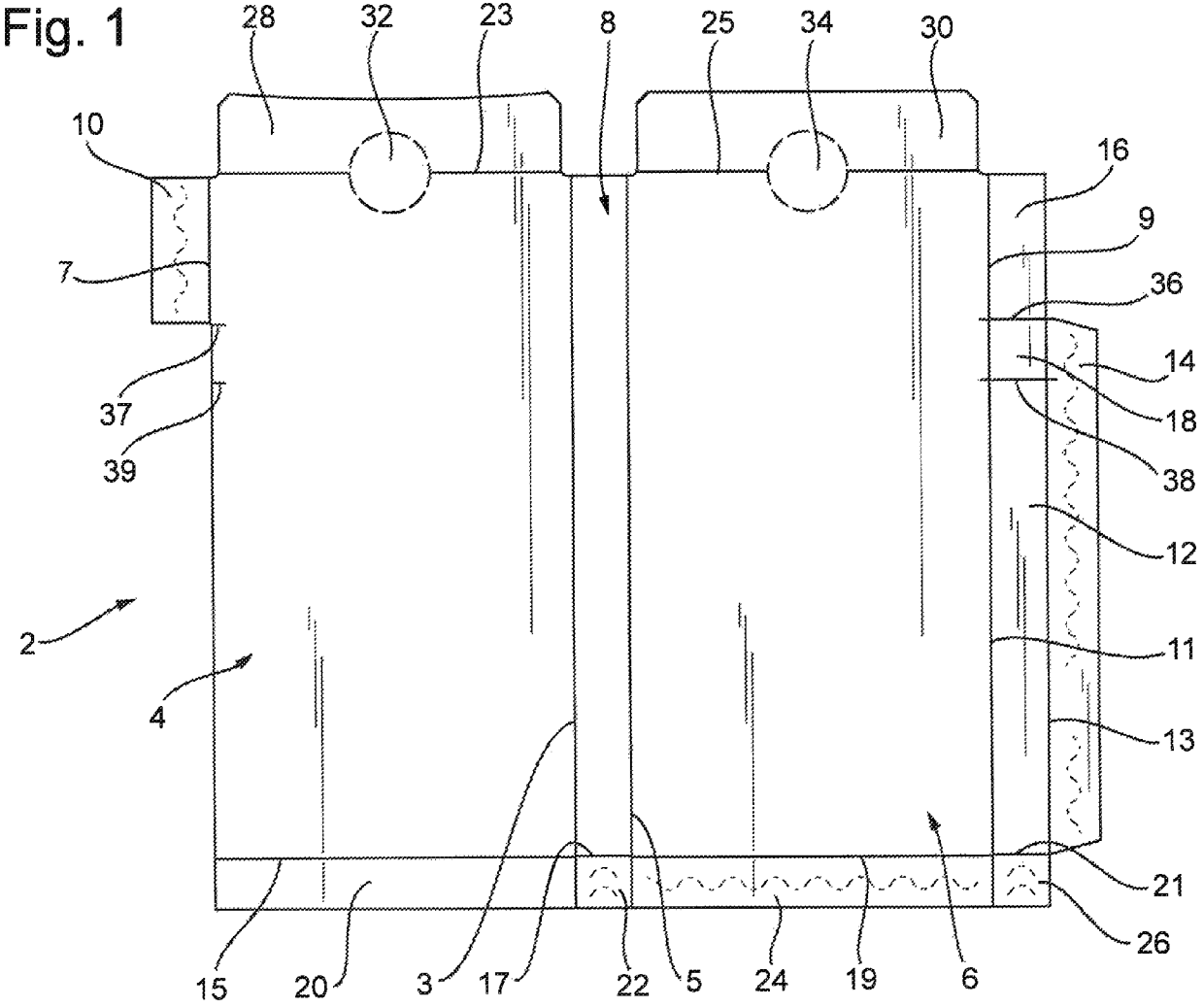
FIG. 1 shows a first blank for providing the container of a package in accordance with one embodiment of the invention.

With reference to FIG. 1, a blank 2 of paperboard or other foldable sheet material as known in the packaging art is shown that may be used to construct a container of a package in accordance with the invention. It will be appreciated that the wavy lines on certain glue flaps e.g. 10, 14 denote scoring which may optionally be applied to facilitate adhesion. FIG. 1 shows the blank from the top side in the flat which will form the exterior of the container. The blank 2 comprises a first panel 4 and a second panel 6 for providing facing panels of the container, and a third panel 8 for providing one side wall of the container. The first and second panels 4, 6 are connected via first and second fold lines 3, 5 to opposed side edges of the third panel 8. The blank also includes a glue flap 10 connected to the first panel 4 along a third foldline 7. A panel for providing the opposite side wall of the container has been slit along a cutline 36 to define a top flap 16 and a lower fourth panel 12. The cutline 36 extends into the second panel 6. The flap 16 and fourth panel 12 are connected along fourth and fifth fold lines 9, 11 to the second panel 6. A glue flap 14 is connected to the fourth panel 12 along a sixth foldline 13 along a side edge of the panel 12 opposite to that connected to the second panel 6. A further cutline 38 is provided extending across the entire width of the fourth panel 12, and into the second panel 6 and the flap 14. The cutlines 36 and 38 extend parallel to one another, and are spaced apart in the longitudinal direction. The cutlines define an area 18 therebetween which will provide a release area of a locking feature of a package including the container. Third and fourth cutlines 37 and 39 are provided on the first panel 4 below the glue flap 10, which will provide a continuation of cutlines 36 and 38 when the blank is erected. In the embodiment shown in FIG. 1, the cutlines 36, 38 extend into the panel 6, and the cutline 38 also extends into the panel 14.

It will be appreciated that while such arrangements are advantageous to facilitate operation of the release area, this is not essential, and the cutlines 36, 38 may be confined to the sidewall. Furthermore, the cutlines 36, 38 may not be straight, and may be e.g. curved, or of any other shape to provide a release area. Finally, it will be appreciated that only one cutline e.g. cutline 36 may be provided. It is also envisaged that a release area may be provided that is not defined by specific structural feature(s) of the container sidewall. For example, if the sidewall is made of a suitably flexible material, it may be deflected by the user without additional features to facilitate such deformation. Whether or not the release area is defined by structural features, a marking may be provided on the container e.g. the sidewall thereof indicative of how the release of the abutment may be effected and/or the position of the release area e.g. "press here".

The blank also includes a flap 20 for providing a bottom end wall of the container, and a set of construction flaps 22, 24, 26 for attachment to the flap 20. The flaps 20, 22, 24 and 26 are connected respectively to the first panel, third panel, second panel and fourth panel 12 along respective seventh, eighth, ninth and tenth fold lines 15, 17, 19 and 21. At the opposite end, which will define the top of the container, the blank includes flaps 28 and 30 connected along respective eleventh and twelfth fold lines 23, 25 to the first and second panels 4, 6. Perforations defining circular removable portions 32 and 34 are provided between the flaps 28 and 30 respectively and the first and second panels 4,6, in the central portion of the panels 4, 6 between their side edges. The portions 32 and 34 may be removed by a user to define thumb notches. It will be appreciated that any suitably shaped removable portions may be used that will define a thumb notch in the top edge of the panels 4, 6 when removed as described below.

Foldlines 3, 5, 7 and 13 are all parallel to one another. Foldlines 9 and 11 are parallel to each of foldlines 3, 5, 7 and 13. Foldlines 15, 17, 19, 23 and 25 are also parallel to one another, and perpendicular to foldlines 3, 5, 7, 9, 11 and 13.

Erection of the container from the blank of FIG. 1 will now be described. For ease of reference, the surface of the blank, and the panel/flaps thereof visible in FIG. 1 will be referred to as the exterior surface thereof, with the opposite surface of the blank (and the panels/flaps thereof) being referred to as the interior surface. The blank is folded about the various fold lines. The exterior surface of flap 10 is glued to the interior surface of the flap 16. The exterior surface of flap 14 is glued to the interior surface of the first panel 4 along the side edge below flap 10. The exterior surfaces of flaps 22, 24, and 26 are glued to the interior surface of flap 20. The flaps 28, 30 are folded through 180 degrees onto the interior surfaces of first and second panels 4 and 6 respectively. Flap 30 is glued down on to the interior surface of panel 6, while flap 28 is left free.

Figure 2:
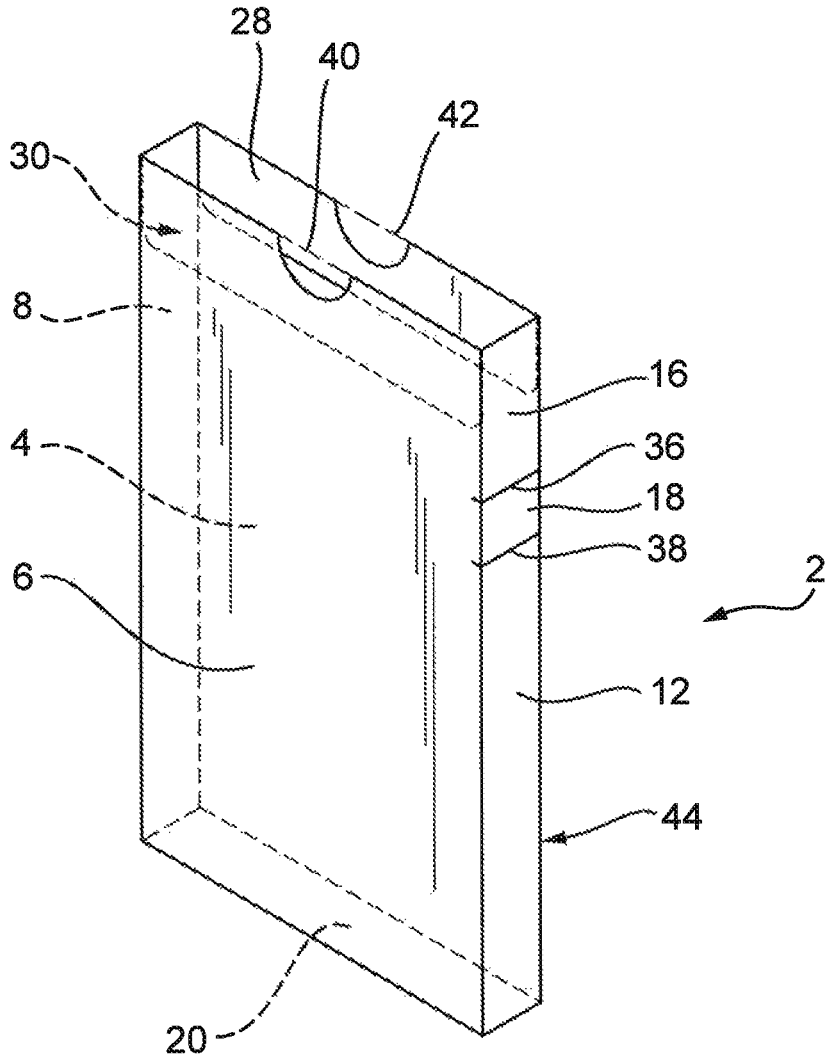
FIG. 2 shows the container obtained by erecting the blank of FIG. 1.

In this way a container 2 as illustrated in FIG. 2 is produced. The same reference numerals will be used to refer to the parts of the container corresponding to parts of the blank identified in relation to FIG. 1. The container 2 has a closed bottom end, defined by end wall 20 and an opposed open top end. The container has facing panels 4, 6, provided by the first and second panels of the blank, and side walls 44 and 46. Side wall 46 is provided by panel 8 of the blank. Side wall 44 is provided by top flap 16 and the lower fourth panel 12 of the blank. The sidewall 44 includes the cutlines 36 and 38 defining a release area 18 therebetween. The cutlines enable the release area to be depressed out of the plane of the sidewall toward the interior of the container. The cutlines 37, 39 provide a continuation of the cutlines 36, 38 on to the first panel 4 to further facilitate depression of the release area. At the open end of the container, the flaps 28 and 30 have been folded back against the interior of facing panels 4 and 6. In this way, the removable portions 32, 34 define semicircular removable portions 42 and 40 respectively along the edges of the container defined by the folding of flaps 28 and 30. These portions 42, 40 may be removed by a user to define respective thumb notches along the top edges of the container to facilitate gripping of the slider therein and hence its withdrawal from the container. Rather than defining removable portions 32, 34 using perforations, in alternative arrangements the portions 32, 34 could be circular cutouts, to define semi-circular notches in the edges of the container directly when the flaps 28 and 30 are folded. The notches and any removable segments used to define the notches may be of any suitable shape, and need not be of the shape illustrated. It has been found that requiring the user to remove portions from the container in order to define the thumb notches provides an additional level of child resistance, helping to conceal the slider and provide a further barrier to its removal from the container. The bottom edge of the glue flap 10 furthest from the open top end of the container provides a locking edge which may cooperate with a locking edge of the slider inserted in the container as described below.

A second blank for providing a slider and blister pack carrier for the package of the present invention will now be described by reference to FIG. 3, which shows the blank in the flat.

The blank 50 includes a first portion 54 which will provide a slider, and a second portion 56 connected thereto which will provide a carrier for a blister pack.

Referring to the portion of the blank for forming the slider, the blank includes a first panel 58 for forming a base of the slider, and second and third panels 60, 62, connected to respective side edges of the first panel 58 along first and second fold lines 59, 61, which will form the upstanding sidewalls of the slider. A flap 64 is connected to the third panel 62 along a third fold line 63 (here being a scoreline). A fourth panel 67 is connected to an end of the first panel 58 along a fourth fold line 65, and will form an end wall of the slider. A flap 66 is connected to an opposite end of the panel 58 along a fifth foldline 69 (here being a scoreline). Two tabs 68 and 70 extend from the side edges of the fourth panel 67, being connected thereto along sixth and seventh fold lines 71, 73, for purposes to be discussed below.

The first, second, third, sixth and seventh foldlines 59, 61, 63, 71, 73 are parallel to one another. The fourth and fifth foldlines 65, 69 are parallel to one another and perpendicular to the first, second, third, sixth and seventh fold lines.

Turning to the portion 56 of the blank that will provide the blister pack carrier, the blank includes a fourth panel 80 and a fifth panel 82 that will provide respective first and second panels of the blister pack carrier. The fourth panel 80 includes four elongate, parallel slots 84. The fifth panel 82 comprises four parallel rows of dispensing openings 81 aligned with the slots 84. The fourth panel 80 is connected to the fifth panel 82 along an eighth fold line 83 (here being a score line). Of course, a different number of slots may be provided in the fourth panel, with a corresponding number of rows of dispensing openings in the fifth panel 82. The arrangement with four slots, and four rows of dispensing openings is merely exemplary. Each of the openings 81 is covered by a removable cover, defined by perforations which must be removed by a user before the content of a blister may be dispensed. This provides additional child resistance.

A generally trapezoidal blocking tab 86 is connected to a side edge of the fourth panel 80 via a connecting leg 88 at the end of the fourth panel 80 adjacent the foldline 83 connecting the panel to the fifth panel 82. The connecting leg 88 is connected to the side edge of the fourth panel via a ninth fold line 89. As will be illustrated below by reference to FIG. 10, in alternative embodiments a blocking panel may instead be connected to the free end edge of panel 80. Furthermore, a blocking tab or panel may be provided as a separate piece inserted between the fourth and fifth panels rather than being attached to one of the panels along a foldline.

The fifth panel 82 is connected to the end wall 67 of the slider along a tenth foldline 85.

The fourth panel 80 comprises an arcuate cut line 90 which defines a tab. The cut 90 is positioned such that when the connecting leg 88 having the blocking tab 86 is folded about the foldline 89 connecting it to the side edge of the fourth panel 80, the tab defined by the arcuate cut 90 is generally aligned with the distal end of the blocking tab 86.

The fifth panel 82 is provided with an arcuate cut line 92 defining a tab which, when the fourth panel 80 is folded over the fifth panel 82 is also generally aligned with the blocking tab 86.

The eighth foldline 83 and the tenth foldline 85 are parallel to one another and to the fourth foldline 65. The ninth foldline 89 is parallel to the sixth and seventh foldlines 71, 73 and perpendicular to the eighth and tenth foldlines 83, 85.

Figure 5A:
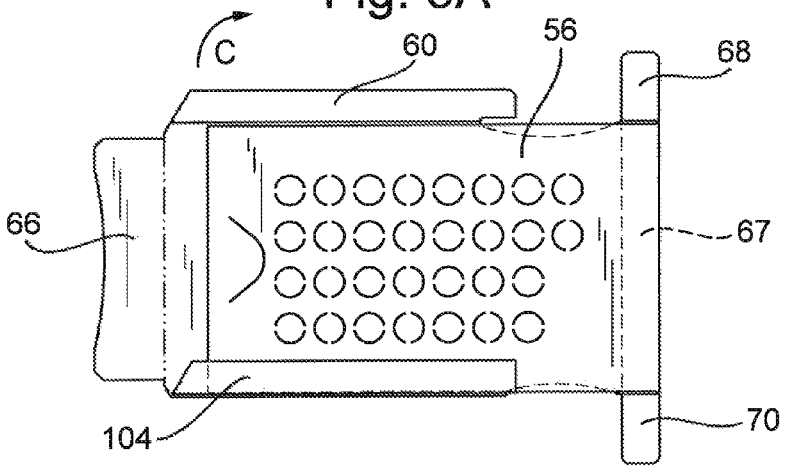
FIG. 5A illustrates the blister pack carrier obtained in a storage position within the slider.

Erection of a slider and blister pack carrier in accordance with one exemplary embodiment of the invention from the blank of FIG. 3 will now be described. The same reference numerals will be used to refer to the parts of the slider and blister pack carrier corresponding to parts of the blank identified in relation to FIG. 3. The erected slider is shown in FIG. 5A.

Figure 3:
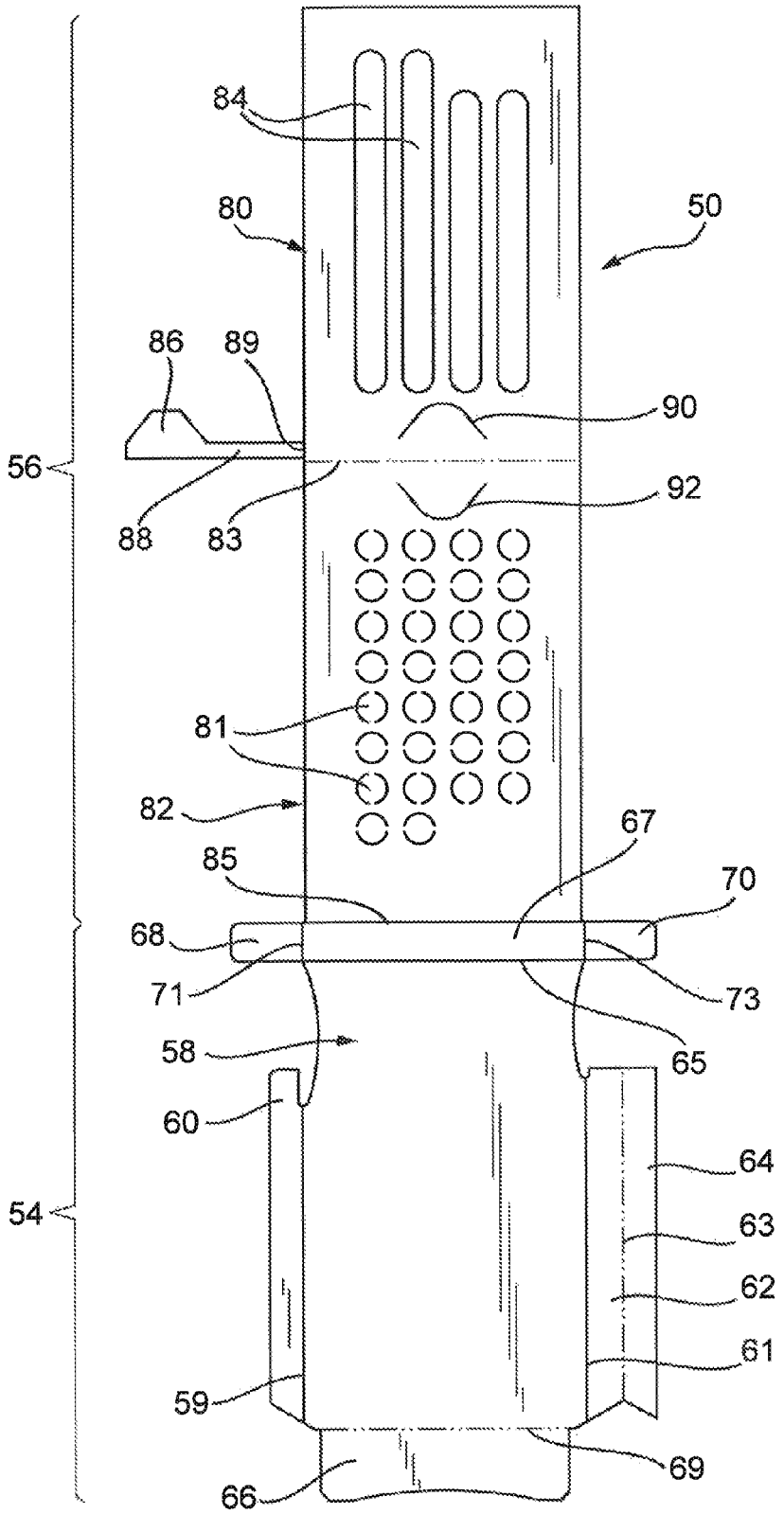
FIG. 3 shows a second blank for providing a slider and blister pack carrier of the package in accordance with one embodiment of the invention.

The view of the blank shown in FIG. 3 shows the surface of the blank that will form the interior surface of the slider when folded. References to the interior surface of the blank, or a component thereof, refer to the surface that is visible in FIG. 3. The exterior surface refers to the opposite surface thereof.

In one exemplary embodiment, the flap 64 is folded through 180 degrees and secured to the exterior surface of the third panel 62 using adhesive. This will provide a two ply sidewall 104 of the slider. Of course, such a two ply sidewall could alternatively be provided by joining a separate piece to the sidewall panel of the slider. Furthermore, it will be appreciated that the slider might only have a single sidewall, being that defining the locking edge.

The blister pack carrier is then constructed. Construction of the blister pack carrier will be described by reference to FIGS. 3 and 4A-D. FIGS. 4A-D omit the slider portion of the blank (connected to the end of panel 82 opposite to that connected via the foldline 83 to panel 80) for ease of illustration. The same reference numerals will be used to refer to the parts of the blister pack carrier corresponding to parts of the blank identified in relation to FIG. 3.

Figure 4A:
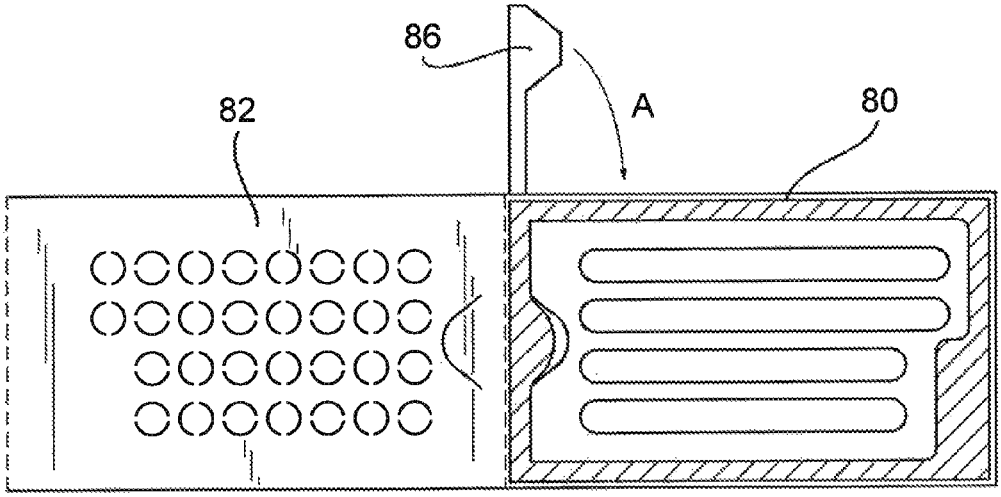
FIGS. 4A-D illustrate the steps involved in constructing the blister pack carrier from the blank of FIG. 3.
Figure 4B:
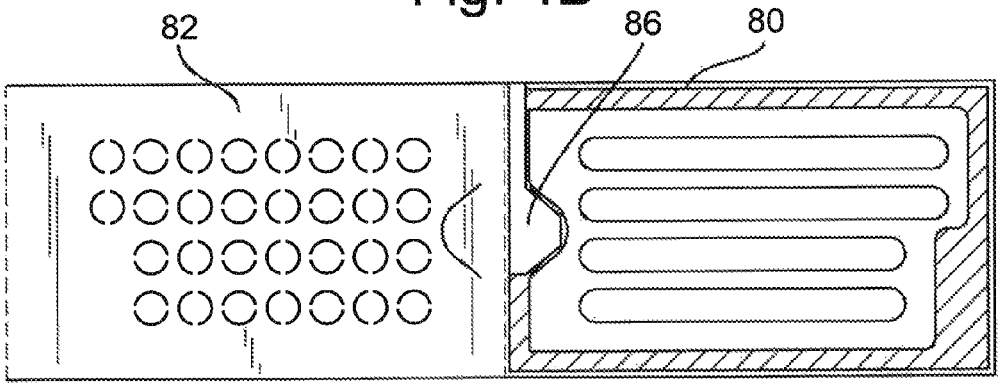

With reference to FIGS. 3 and 4A, glue is applied to the shaded region of the fourth panel 80. The blocking tab 86 is folded about the ninth foldline 89 connecting the connecting portion 88 to the side edge of the fourth panel 80 in the direction of the arrow A shown in FIG. 4A to a position in which the blocking tab 86 is aligned with the tab defined by the cut 90. This position is shown in FIG. 4B. The blocking tab 86 is secured in this position by the glue.

Figure 4C:
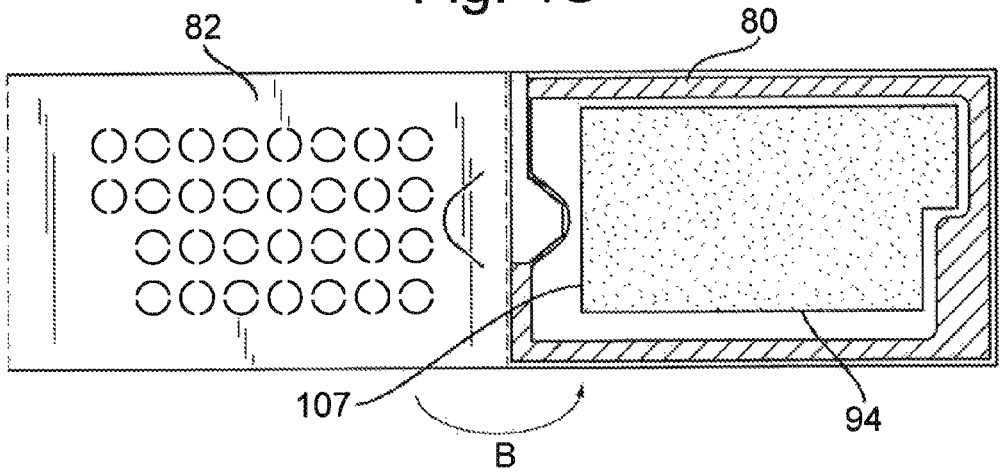

As shown in FIG. 4C, a blister pack 94 having four parallel rows of blisters, with 8, 8, 7 and 7 blisters therein respectively is positioned such that the blisters are located within the slots 84 of the fourth panel 80, with leading edge 107 of the blister pack 94 being spaced from the tip of the blocking tab 86. The blister pack is positioned within the region of the fourth panel that has not had glue applied thereto.

The fifth panel 82 is then folded about the eighth fold line 83 connecting it to the fourth panel 80 in the direction of the arrow B so as to overlie the surface of panel 80 and trap the blister pack 94 between the two panels 82, 84.

Of course, alternatively the fourth panel 80 may be folded over the fifth panel 82. In such cases, further steps may be needed to locate the blister pack on the second panel 82.

Figure 4D:
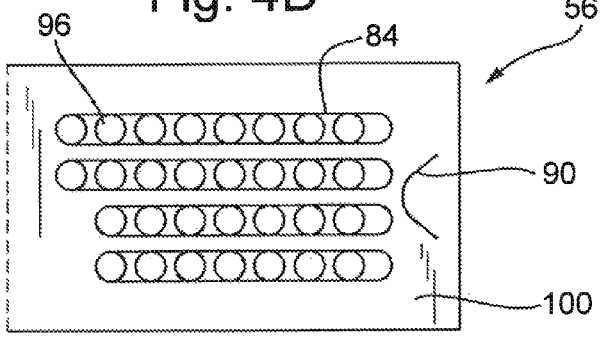

The resulting blister pack carrier 56 is shown in FIG. 4D. The blister pack carrier is shown from the side of the first panel 100 (corresponding to panel 80 of the blank), and which has the parallel slots 84. Blisters 96 of blister pack 94 located between the first panel 100 and a second panel 102 of the carrier (corresponding to panel 82 of the blank) are disposed in the slots 84.

The blister pack carrier 56 is then folded about the tenth foldline 85 so as to overlie the first panel 58 of the slider. The second and third panels 60, 62 of the slider are folded along the first and second foldlines 59, 61 connecting them to the first panel 58 to provide sidewalls of the slider, upstanding from a base provided by first panel 58. The flap 66 is folded toward the interior surface of the first panel 58 about fifth foldline 69. Of course, in alternative embodiments, the second and third panels 60, 62 of the slider may be folded along the first and second foldlines 59, 61 to provide upstanding walls before the blister pack carrier 56 is folded along foldline 85 to overlie the first panel 58 of the slider.

The blank 50 including the slider and blister pack carrier may be rotated one or more times during the above described erection steps to facilitate handling.

It will be appreciated that the order of steps in constructing the blister pack carrier and/or slider, and arranging the blister pack carrier relative to the slider may vary from the above described exemplary method, depending upon factors such as the techniques and configuration of adhesive used, and the configuration and orientation of the manufacturing line and its machinery etc.

Figure 5B:
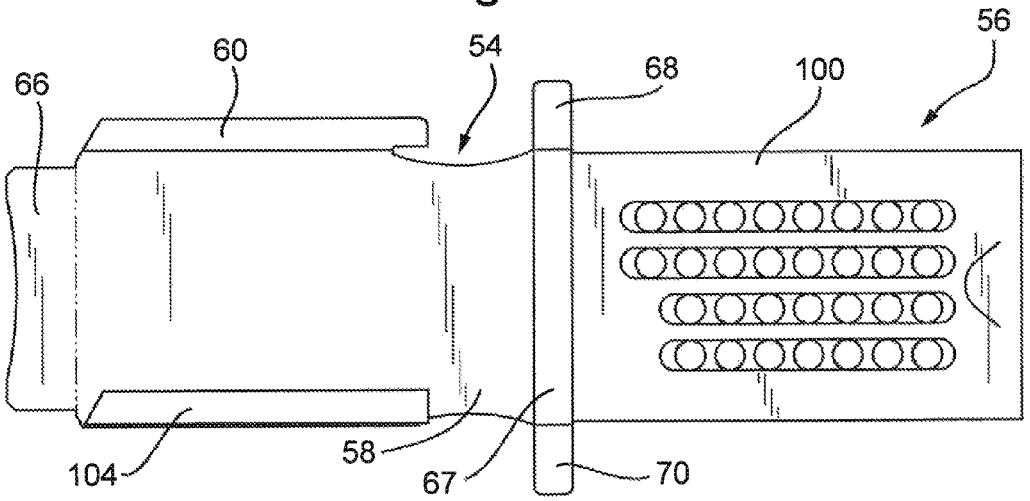
FIG. 5B illustrates the blister pack carrier after it has been moved into a position relative to the slider to permit access to the blisters.

FIG. 5A illustrates the erected blank shown in FIG. 3 with the assembled blister pack carrier 56 in a storage position within the interior space defined by the assembled slider 54. The blister pack carrier is movable in the direction of arrow C through up to 180 degrees, about the foldline 85 connecting it to the end wall 67 of the slider, to the position shown in FIG. 5B to provide access to the blister pack carrier for dispensing the contents of the blisters.

Assembly of the slider 54, with its integrally attached blister pack carrier 56, to the container 2 to provide a package in accordance with the invention will now be described.

The flap 66 of the slider is folded back about fifth foldline 69 toward the facing panel 58 before the slider is inserted in the container. The flaps 68, 70 are folded back about sixth and seventh foldlines 71, 73 toward the transverse ends of the sidewalls 60, 104. The slider is inserted into the container shown in FIG. 2 with the end having the flap 66 first (the first end of the slider). The second (or top) end of the slider is therefore that disposed furthest from the closed end of the container, and having the blister pack carrier connected thereto along the foldline 83. The slider is inserted fully into the container. In this position the transversely extending edge of the double ply sidewall 104 of the slider formed by panels 62 and 64 which is closest to the second end of the slider abuts the locking edge of the container provided by the edge of flap 10 furthest from the open end of the container. The abutment between the locking edges of the container and slider prevent the slider from being slid back out of the container until the abutment is released by a user. The end wall 67 of the slider closes the open end of the container in this position.

Figure 6:
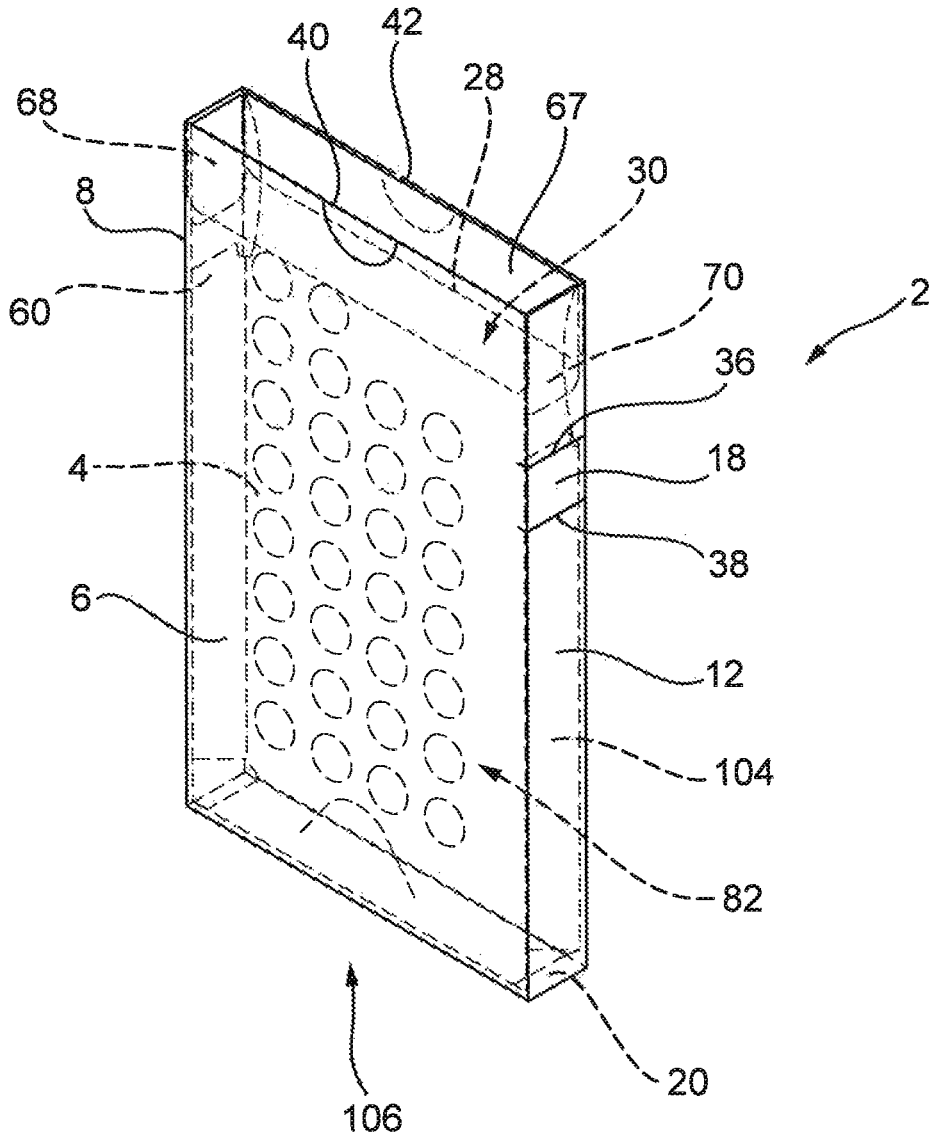
FIG. 6 illustrates a package in accordance with the invention formed by assembling the slider with its blister pack carrier shown in FIG. 5A and the container shown in FIG. 2.

FIG. 6 schematically illustrates the resulting package 106 formed from the slider 54 inserted in the container 2 of FIG. 2, with the blister pack carrier 56 in a storage position.

Figure 7A:
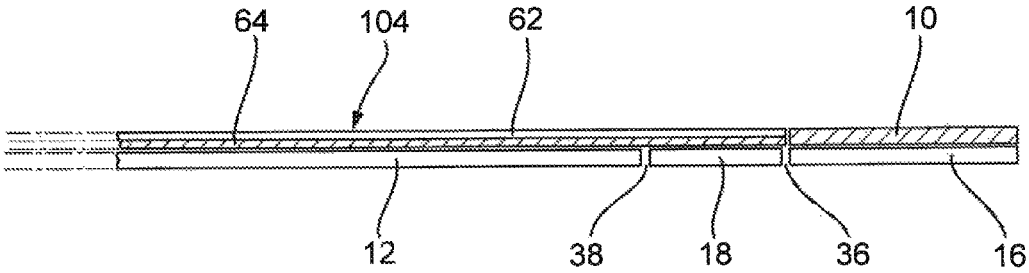
FIG. 7A illustrates a locking abutment between locking edges of the container and slider.
Figure 7B:
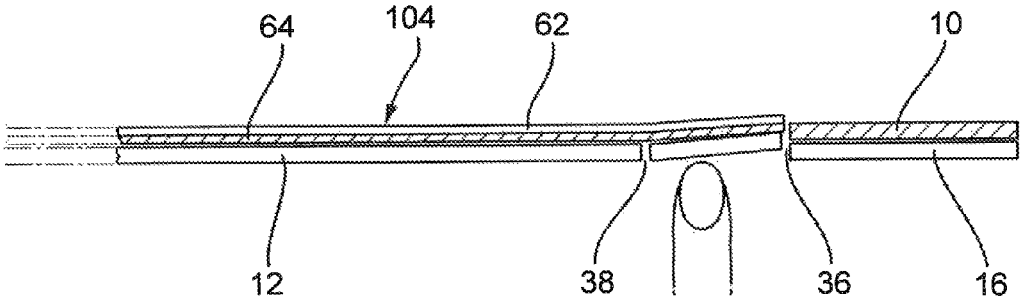
FIG. 7B illustrates the way in which the locking edge of the slider may be moved out of locking abutment with the locking edge of the container under manual pressure.

FIG. 7A is a schematic cross-sectional view of the side of the package showing the locking abutment between the transversely extending end edge of the double ply sidewall 104 made from panels 62 and 64 and the edge of flap 10. FIG. 7B illustrates how, when a user manually exerts pressure on the release area 18 to push it inwardly towards the interior of the package, the locking edge of the sidewall 104 may be deflected to allow it to ride past the locking edge provided by the flap 10. The flaps 68, 70 extending from the side edges of the end wall 67 of the slider have been omitted for clarity.

Operation of the package will now be described.

The package 106 is supplied to a user with the slider 54 inserted in the container 2, and the abutment between the locking edges of the slider and the container preventing the slider from being slid out of the open end of the container to allow access to the blister pack carrier. The user first removes the removable portions 40,42 to define thumb notches in the top edge of the container to facilitate gripping of the slider therethrough. In order to be able to slide the slider out of the sleeve, the user manually presses on the release area 18 as shown in FIG. 7B. This deflects the end of the sidewall 104 of the slider 54 having the locking edge at its distal end out of abutment with the locking edge of the container provided by the panel 10. The user may then, grasping the top of the slider through the thumb notches, slide the slider out of the container, with the sidewall 104 riding past the locking edge of the container. This provides an impediment to a child obtaining access to the blister pack and its carrier, as a particular set of actions must be performed, and a certain degree of pressure exerted on the release area of the container, in order to release the locking abutment. As the release area is defined between cutlines 36 and 38, it may be readily identified by a user, and a more precise area is provided that will deform under manual pressure.

The slider may be slid out of the container to reveal the blister pack carrier, which is in its storage position as shown in FIG. 5A. The slider is prevented from being completely separated from the container by virtue of engagement between the flaps 66 and 28. The user then folds the blister pack carrier 56 out of the slider by moving the free end of the blister pack carrier 56 in the direction of arrow C in FIG. 5A to the position in FIG. 5B.

Initially the blister pack is in a position in which the blisters are not aligned with the dispensing openings 81 in the panel 82. The user must overcome the blocking provided by the blocking tab 86 to be able to slide the blister pack relative to the first and second panels 80, 82 of the blister pack carrier to a position in which the blisters are aligned with the dispensing openings.

Figure 8A:
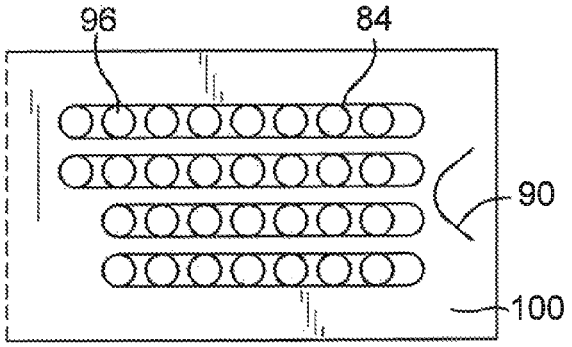
FIGS. 8A to D illustrate the steps involved in obtaining access to the contents of the blister pack held in the blister pack carrier.
Figure 8B:
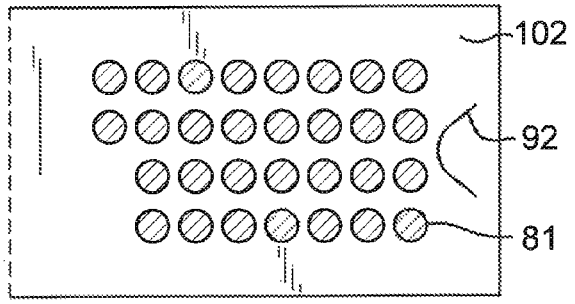

The operation of the blocking tab will be described by reference to FIGS. 8 A-D. FIG. 8A illustrates the blister pack carrier obtained following the steps shown in FIGS. 4A-D, and corresponds to FIG. 4D. FIG. 8B illustrates the carrier from the reverse side i.e. that of the second panel 102 having the dispensing openings 81.

In the view shown in FIGS. 8A and B, the blisters 96 are out of alignment with the respective dispensing openings 81 in the second panel 102 which means that the contents of the blisters 96 cannot be dispensed. Moreover, the blister pack cannot slide between the panels 100, 102 due to a leading edge 107 of the blister pack abutting the tip of the blocking tab.

Figure 8C:
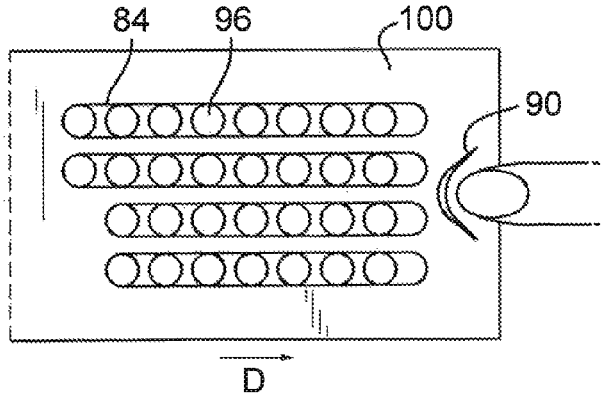
Figure 8D:
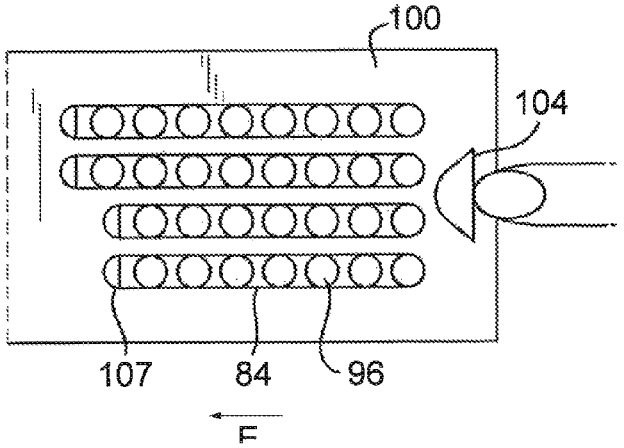

In order to dispense the contents of a blister 96, the tab defined in the first panel 100 by the cut line 90 is pushed inwardly as shown in FIG. 8C. This moves the blocking tab 86 out of alignment with the leading edge 107 of the blister pack 94, the blocking tab 86 being pushed out through cut line 92 in the second panel 102 of the carrier. The blister pack 94 may then be slid in the direction of arrow D) in FIG. 8C such that its leading edge 104 rides up over the tab defined by cut 90 as shown in FIG. 8D. This allows the blisters 96 to align with the dispensing openings 81 in the second panel 102 whereupon the blister contents may be dispensed. The removable covers of the second panel of the blister pack carrier serve to conceal the blister pack 94 until they are removed, during or prior to dispensing. This provides additional child resistance, as a child may be less inclined to investigate the content of the blister pack carrier if they are unable to see the e.g. foil substrate of the blister pack. The removable covers may be of any suitable shape, depending upon the shape of the dispensing openings to be defined, and in turn, the shape of the blister contents, and need not be of the shape illustrated.

The blister pack 94 may then be slid in the opposite direction E as shown in FIG. 8D whereupon the blisters 96 move out of alignment with the dispensing openings 81 and the blocking tab 86 can be moved back into its blocking position under its inherent resilience or by being pushed back into position.

The blister pack carrier may then be returned to its storage position in the slider 54, and the slider 54 slid back into the container 2 until the locking edge of the slider 54 slides past the locking edge of the container 25. The locking edge of the slider 54 will then abut the locking edge of the container once more. The sidewall 104 having the locking edge of the slider 54 will tend to spring outwardly into the locking engagement due to the inherent resilience of the sidewall.

Figure 9A:
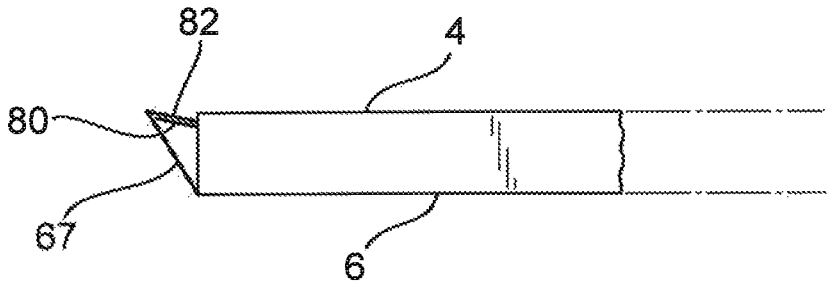
FIGS. 9A and 9B are side views in the vicinity of the top end of an assembled package, illustrating the operation of a further child resistant feature of the invention.
Figure 9B:
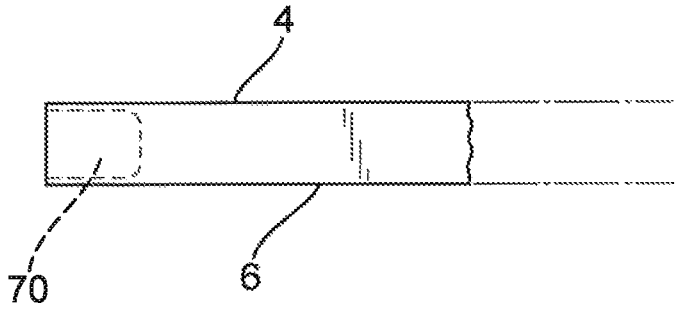

While the slider 54 is disposed within the container 2, the flaps 68, 70 prevent the end wall 67 of the slider 54 from rolling outwardly when a user tries to pull on the end of the slider through the notches defined in the container after removal of portions 40, 42. This provides a further child resistant feature. This effect is illustrated in FIGS. 9A and B. FIG. 9A shows a package in which the flaps 68, 70 are not provided. This is a side view in the vicinity of the top open end of the container, with the slider in its storage configuration, within the container. When a user grips the panels 58, 82 of the slider through the notches the end wall 67 of the slider will tend to roll out of the open end of the container as shown in FIG. 9A, exposing the end of the blister pack carrier defined by panels 80, 82, and potentially providing access to, or facilitating access to blisters of the blister pack. By providing flaps 68, 70, and folding the flaps 68, 70 back toward the closed end of the container, with the flaps being located within the container when the slider is in its storage position as shown in FIG. 9B, this problem is avoided, as the flaps 68, 70 prevent outward rolling of the panel 67 from the open end of the container. FIG. 9B is a schematic side view of the package shown in FIG. 6 in the vicinity of the top end, with some features of the locking means omitted for clarity. This is particularly useful in the context of a blister pack which includes only one layer of blisters, without a further layer of blisters provided which might interlock with the blisters to inhibit movement of the blister pack carrier and hence rolling out of the end wall 67

Figure 10:
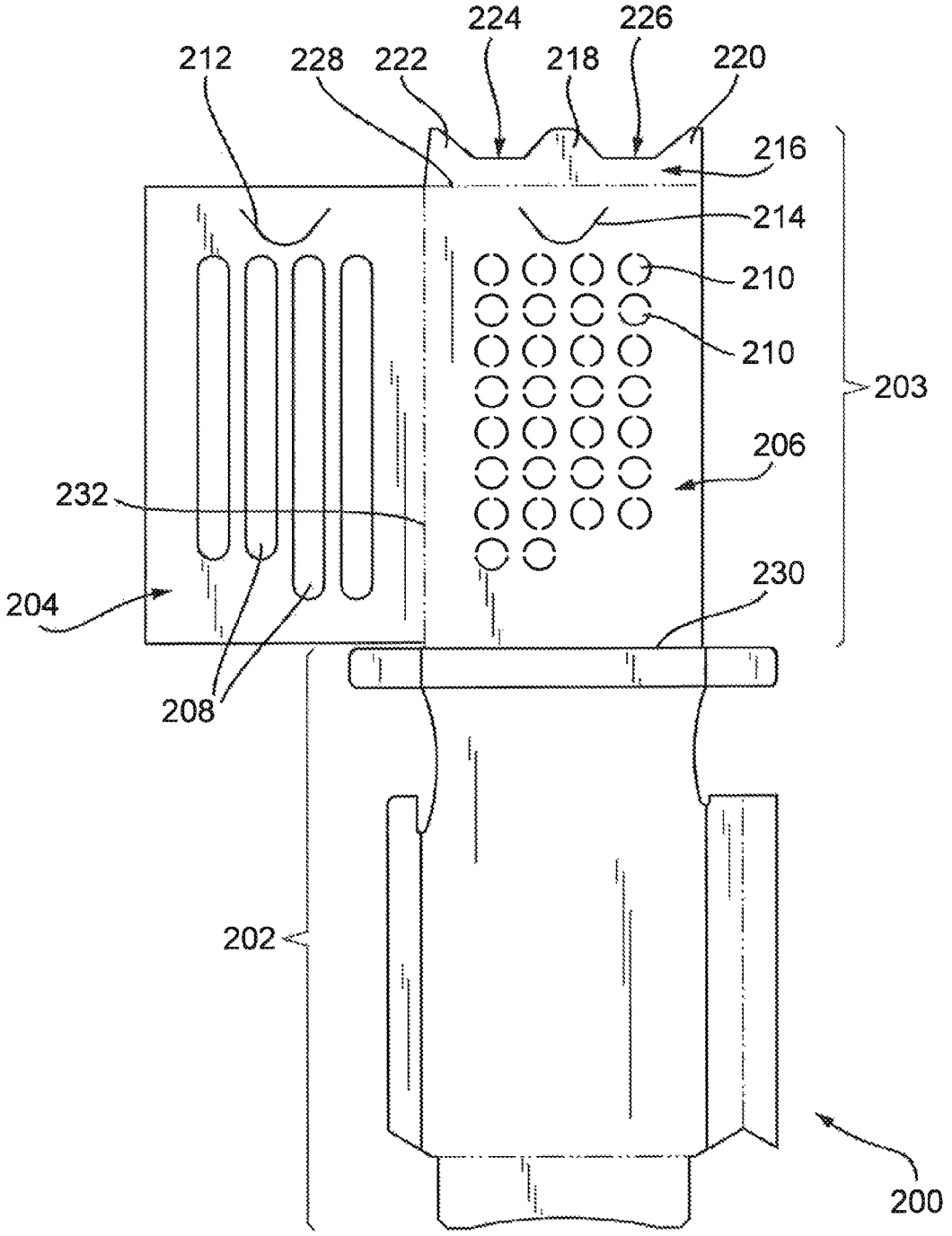
FIG. 10 illustrates a further blank for providing a slider and blister pack carrier of a package in accordance with another embodiment of the invention.

FIG. 10 illustrates an alternative blank 200 in the flat for providing a slider and blister pack carrier of a package in accordance with the present invention.

The blank 200 includes a first portion 202 which will provide a slider, and a second portion 203 connected thereto which will provide a carrier for a blister pack. The portion of the blank providing the slider is identical to the portion of the blank described above by reference to FIG. 3, and will not be further described.

Referring to the portion 203 of the blank that will provide the blister pack carrier, the blank includes a first panel 204 and a second panel 206 that will provide respective first and second panels of the blister pack carrier. The first panel 204 includes four elongate, parallel slots 208. The second panel 206 comprises four parallel rows of dispensing openings 210 (having removable covers) alignable with the slots 208 when the first panel is folded over the second panel. The first panel 204 is connected to the second panel 206 along a first foldline 232 (in the form of a scoreline).

A blocking device in the form of a blocking panel 216 is attached by its proximal edge to the end of the second panel 206 along a second foldline 228 (in the form of a scoreline), at an opposite end of the second panel to the end attached to the slider along third fold line 230. The blocking panel has a distal edge which defines a central peak 218 which provides a generally trapezoidal blocking tab. The central peak 218 is located between two valleys 224, 226, with further peaks 222, 220 being provided on either side of the valleys. It will be appreciated that the additional peaks 222, 220 may be omitted, depending upon particular requirements e.g. in terms of size/width and strength.

The first panel 204 comprises an arcuate cut line 212 which defines a tab. The cut 212 is positioned such that when blocking panel 216 having tab 218 is folded about the second foldline 228 connecting it to end edge of the second panel 206, the tab defined by the arcuate cut 212 is generally aligned with the distal end of the blocking tab 218. The second panel 206 is provided with an arcuate cut line 214 defining a tab which, when the first panel 204 is folded over the second panel 206 is also generally aligned with the blocking tab 218.

The second and third foldlines 228, 230 are parallel to one another. The first foldline 232 is perpendicular to the second and third foldlines 228, 230.

The first and second panels 204, 206 of the blister pack carrier in this further embodiment are therefore of the same construction as the first and second panels 80, 82 of the blister pack carrier of the earlier embodiment, but are connected to one another in a side by side configuration, rather than end to end. The blocking member differs from the earlier embodiment in that it is connected to a free end edge of a panel of the blister pack carrier, rather than a side edge thereof. A blocking member provided in this way may, in some situations, be easier to handle and glue in place than an elongate blocking member extending from a side edge of a blister pack carrier panel as shown in FIG. 3.

It is envisaged that a blocking member at an end edge of the blister pack carrier could alternatively be provided by a separate piece located between the panels of the carrier, and which is not connected to one of the panels along a foldline.

The blank of FIG. 10 may be constructed in the same manner as the earlier embodiment of FIG. 3. In one exemplary process, rather than assembling the blister pack carrier by folding the blocking member 86 along the foldline 89 over the first panel 80 and adhesively securing it thereto, and then folding the second panel 82 over the first panel 80 after location of the blister pack, in this further embodiment the blocking panel 216 is folded along the second foldline 228 over the second panel 206, and secured in place using adhesive applied to the peaks 218, 222, 220. The blister pack is located, and the second panel 206 folded along the first foldline 232 over the first panel 204 and adhesively secured thereto. The resulting blister pack carrier may then be folded about the third foldline 230 over the facing panel 58 of the slider in the same manner as the earlier embodiment. Of course, the sequence of steps may be varied as in the earlier embodiment.

Figure 11:
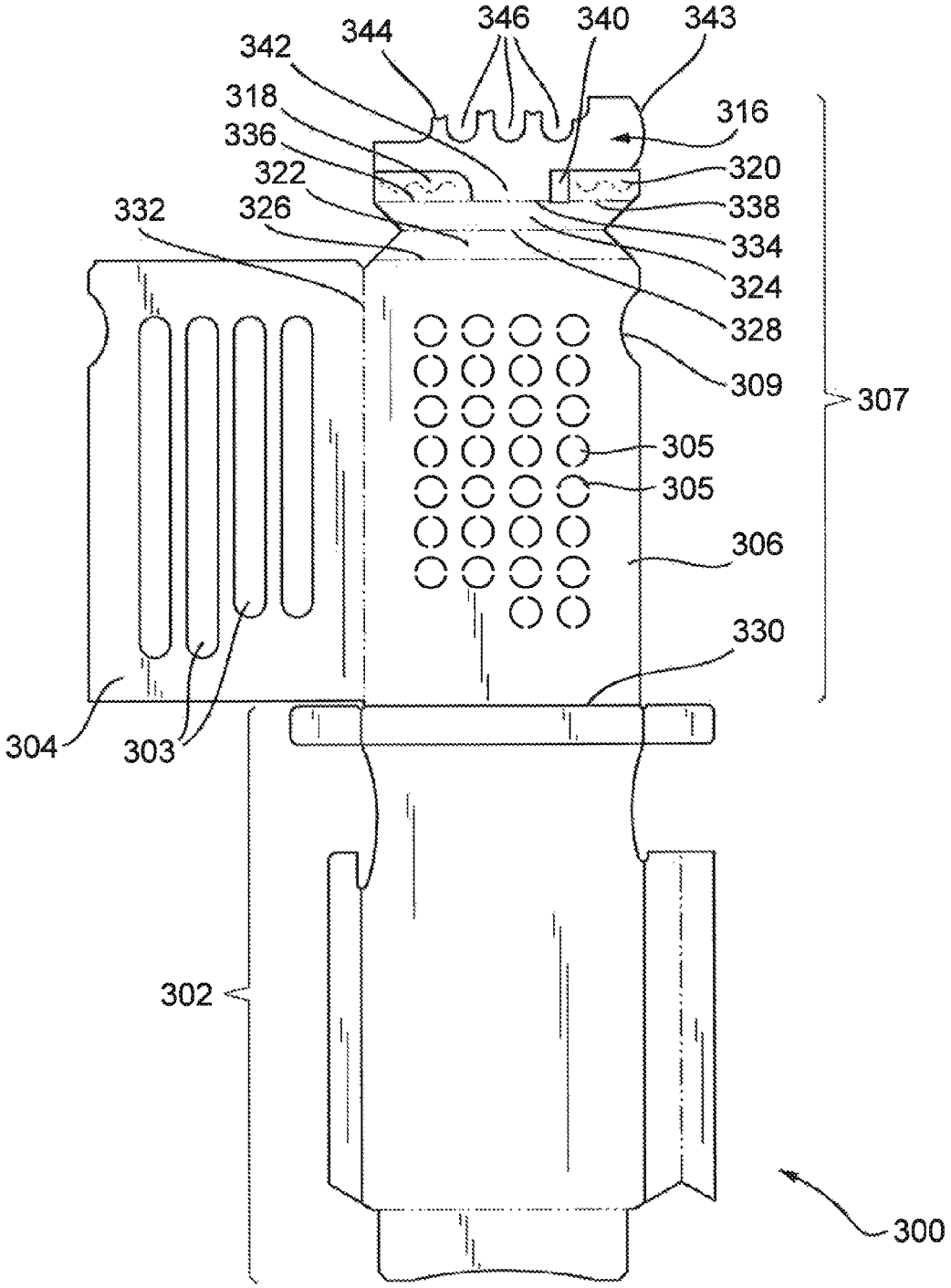
FIG. 11 illustrates a further blank for providing a slider and blister pack carrier of a package in accordance with another embodiment of the invention.

FIG. 11 illustrates yet another alternative blank 300 in the flat for providing a slider and blister pack carrier of a package in accordance with the present invention. This blank incorporates a different type of blocking member, similar to that described in the embodiment of FIGS. 3-4J of GB 2451850. While the blocking arrangement of the embodiment of FIG. 11 is a variant on the embodiments described in GB 2451850, it will be appreciated that arrangements in accordance with GB 2451850 may alternatively be used.

The blank 300 includes a first portion 302 which will provide a slider, and a second portion 307 connected thereto which will provide a carrier for a blister pack. The portion of the blank providing the slider is identical to the portion of the blank described above by reference to FIG. 3, and will not be further described. Referring to the portion 307 of the blank that will provide the blister pack carrier, the blank includes a first panel 304 and a second panel 306 that will provide respective first and second panels of the blister pack carrier. The first panel 304 includes four elongate, parallel slots 303. The second panel 306 comprises four parallel rows of dispensing openings 305 alignable with the slots 303 when the first panel is folded over the second panel. The openings 305 have removable covers as described in relation to the earlier embodiment. The first panel 304 is connected to the second panel 306 along a first foldline 332.

A generally T-shaped blocking panel 316 is attached to the end of the second panel 306 opposite the end connected to the slider along a second foldline 330. The blocking panel through a pair of intermediate panels 322, 324 connected together about a third foldline 328. The first intermediate panel 322 is attached to the second panel 306 about a fourth foldline 326 (here defined by a scoreline) while the second intermediate panel 324 is attached to the blocking panel 316 along a fifth foldline 334.

First and second stop panels 318, 320 are also attached to the second intermediate panel 324 about respective sixth and seventh foldlines 336, 338 (defined by scorelines) which are aligned with each other and with the fifth foldline 334. The stop panels 318, 320 are not attached to the blocking panel 316. A space 340 is provided between the stop panel 320 and the lower limb 342 of the blocking panel 316.

The free edge 344 of the blocking panel 316 is provided with three recesses 346 which are generally arcuate at least in part so as to receive a blister in use. The second panel 306 is provided with a notch 309 along its free side edge. The right hand edge 343 is curved.

Erection of the blank 300 may proceed in a similar manner to that described by reference to FIG. 10. The only differences arise in relation to the blocking member. Glue is applied to the first and second stop panels 318 and 320. The blocking panel 316 and the second intermediate panel 324 are folded about foldline 328. This brings the first and second intermediate panels 322, 324 into face to face contact with one another, and the stop panels 318, 320 and blocking panel 316 into face to face contact with the end of the second panel 306 between the dispensing openings 305 and the foldline 326. The glue applied to the stop panels 318, 320 adheres them to the second panel 306. No attachment e.g. gluing occurs between the blocking panel 316 and the first panel 306, however. The recesses 346 provided in the blocking panel 316 are not aligned with the rows of dispensing openings in the second panel 306. The curved edge 343 of the blocking panel 316 is aligned with the notch 309 in the second panel 306. The wavy lines on stop panels 318 and 320 denote optional scoring to facilitate adhesion of the glue.

In this position, the foldlines 336 and 326 are aligned with one another. A cut is made along this line, to sever the intermediate panels 322, 324 from the second panel 306 and the blocking panel 316.

A blister panel is then located between the first and second panels 304, 306, and the first panel 304 folded over the second panel 306, and adhesively attached thereto, in a similar manner to the earlier embodiments.

It will be appreciated that once the blister pack carrier is assembled, in its initial position, the blisters of the blister pack do not align with the openings 305 in the second panel, 306, and the blister pack is prevented from sliding between the first and second panels by the blocking panel 316.

To dispense the contents of a blister, the user must retract the blocking panel from between the first and second panels 304, 306. This is done by sliding the blocking panel 316 to the right, by gripping the rounded edge 343 of the panel through notch 309 and pulling the blocking panel in a direction out of the space between the first and second panels. Such movement is permitted by the space 340. The blocking panel 316 may move in this direction until the limb 342 engages the second stop panel 320 to prevent complete removal of the blocking panel. At this point the recesses 346 align with the rows of dispensing openings 305. The blister pack may then be slid upwardly toward the end of the blister pack carrier having the blocking panel, to align the blisters with the dispensing openings 305. After dispensing, the blister pack may be returned to its original position, and the blocking panel 316 slid back to the left to its original position, in which further movement is prevented by engagement of the limb 342 with the stop panel 318.

Figure 12:
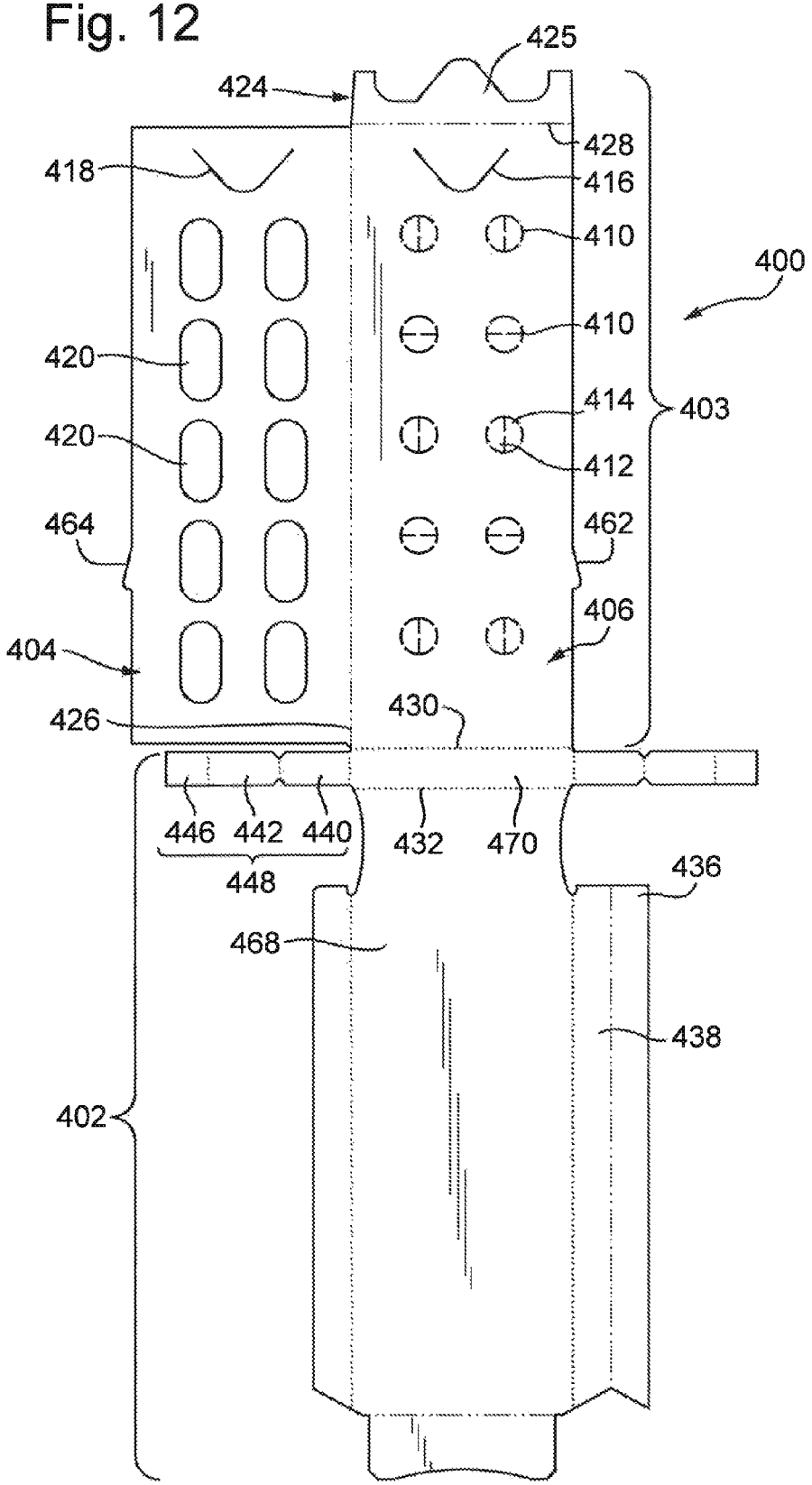
FIG. 12 illustrates a further blank for providing a slider and blister pack carrier of a package in accordance with yet another embodiment of the invention.

FIG. 12 illustrates an alternative blank 400 in the flat for providing a slider and blister pack carrier of a package in accordance with another embodiment of the present invention. The slider is used with a container in accordance with the earlier described embodiments i.e. as shown in FIG. 1. This Figure illustrates the blank as seen from the surface that will form the exterior of the slider and blister pack carrier in use. This embodiment includes a number of additional or alternative features, any or all of which may be incorporated in the earlier embodiment of the slider and blister pack carrier described by reference to FIGS. 3-11.

The blank 400 is similar to that shown in FIG. 10. The blank 400 includes a first portion 402 which will provide a slider, and a second portion 403 connected thereto which will provide a carrier for a blister pack.

Referring to the portion 403 of the blank that will provide the blister pack carrier, the blank includes a first panel 404 and a second panel 406 that will provide respective first and second panels of the blister pack carrier. The first panel 404 includes two parallel rows of slots 420. The second panel 406 comprises two parallel rows of dispensing openings 410. Each dispensing opening 410 is alignable with a respective one of the slots 420 when the first panel is folded over the second panel. The first panel 404 is connected to the second panel 406 along a first foldline 426 (in the form of a scoreline). It will be seen that, in contrast to the earlier described embodiments, each one of the slots 420 is of a length which may accommodate only a single blister in use, rather than a row of blisters. One slot 420 is provided in respect of each blister. It has been found that this may enhance child resistance, making it more difficult for a child to try to extract a blister pack via the slots in use. It will be appreciated that rather than using a slot of the length to accommodate an entire row of blisters as shown in the earlier embodiments e.g. of FIG. 3, 10 or 11, these earlier embodiments may similarly employ shorter slots of a length to each accommodate a single blister in use.

A blocking device in the form of a blocking panel 424 having a central tab 425 is attached by its proximal edge to the end of the second panel 406 along a second foldline 428 (in the form of a scoreline), at an opposite end of the second panel to the end attached to the slider along third fold line 430. The blocking panel is of a similar shape to that shown in FIG. 10.

The first panel 404 comprises an arcuate cut line 418 which defines a tab. The cut 418 is positioned such that when blocking panel 424 having tab 425 is folded about the second foldline 428 connecting it to end edge of the second panel 406, the tab defined by the arcuate cut 418 is generally aligned with the distal end of the blocking tab 425. The second panel 406 is provided with an arcuate cut line 416 defining a tab which, when the first panel 404 is folded over the second panel 406 is also generally aligned with the blocking tab 425.

The second and third foldlines 428, 430 are parallel to one another. The first foldline 426 is perpendicular to the second and third foldlines 428,430. The end wall 470 is connected to a, panel of the slider along the foldline 432 at an edge opposite that defined by foldline 430.

The embodiment of FIG. 12 also illustrates a preferred configuration for the removable covers covering the dispensing openings 410. Here, each cover comprises two semi-circular removable segments 412, 414, which are defined by perforations. The use of covers of this construction has been found to further increase child resistance, as the child must remove both segments of the cover before being able to access a blister of the underlying blister pack in use. This requires greater manual dexterity and persistence, reducing the likelihood that a child will successfully access an underlying blister. The covers provided for the dispensing openings of the invention in any of its other embodiments illustrated e.g. in FIG. 3, 10 or 11 may similarly be provided by multiple removable segments in this way. It will be appreciated that the removable covers, and the segments may be of different shapes to those illustrated, depending upon the desired shape of the dispensing openings, and the blister contents.

The embodiment of FIG. 12 also differs from the earlier embodiments of FIG. 3,10 or 11 in the portion 402 defining the slider. The only difference is in relation to the flaps extending from the side edge of the end wall 470 which prevent rollout of the end wall 470 of the slider. The other features of the slider are identical to those of the earlier embodiments of FIG. 3, 10 or 11 and will not be described again. In contrast to the flaps 68, 70 of the FIG. 3 embodiment, in this further embodiment each flap is made up of an array of flap panels with a tab connected thereto. Referring to the array 448, this includes a first flap panel 440, a second flap panel 442 and a tab 446. The array attached to the opposite side edge is of the same construction and will not be further described. The second flap panel 442 is folded back over the first flap panel 440 and secured thereto to provide a two ply flap. The tab 446 is secured to the end wall 470. The tab acts to reinforce the edge of the end wall 470. These features have been found to further enhance child resistance, and decrease the likelihood of roll out of the end wall 470 of the slider, and hence of a child obtaining access to the blister pack. The construction of a two ply flap using the array on the other side of the end wall is identical. The resulting slider has a pair of flaps extending from either side of the end wall 470 thereof, as shown in FIG. 3 or FIG. 10 or 11, but each which flap is a two ply flap, and with added reinforcement of the end wall 470 toward the edges thereof.

It will be appreciated that the length of the tab associated with each flap may be increased if desired to provide additional reinforcement of the end wall 470. For example, the tabs may be increased in length so that the distal ends thereof abut one another at the center of the end wall 470 when secured thereto.

The blank 400 also includes a further feature associated with the blister pack carrier. The outer longitudinal side edges of the first panel 404 and the second panel 406 of the blister pack carrier includes respective projections 464, 462. When the first and second panels are secured to one another with the blister pack therebetween in assembly of the blister pack carrier, these projections 464, 462 will be joined in face to face contact, to provide a two ply projection on the side edge of the resulting blister pack carrier, closer to the second end of the slider. When the blister pack carrier is folded onto the slider facing panel 468, the projection will engage the double ply sidewall 104 of the slider formed from panels 436,438. When the slider is disposed in the container, the projection therefore biases the locking edge associated with the sidewall 104 into engagement with the locking edge of the container. This arrangement is shown in more detail in FIG. 13.

It will be appreciated that this embodiment of FIG. 12 therefore illustrates a number of preferred features; the slots 420 in the first panel 404 of the blister pack carrier having a length to accommodate a single blister, the segmented covers for dispensing openings 410, the biasing projection and the arrays e.g. 448, for providing the anti-roll out flaps. Although the illustrated embodiment incorporates all of these features, it will be appreciated that any one or ones of these features may be omitted, or any combination thereof may be used. Similarly, any one or ones of these features may be incorporated in the earlier embodiments of FIGS. 3-11.

The blank of FIG. 12 may be constructed in the same manner as the earlier embodiments of FIGS. 3 and 10. Similarly, use will proceed in the same manner as described in the earlier embodiments.

Figure 13:
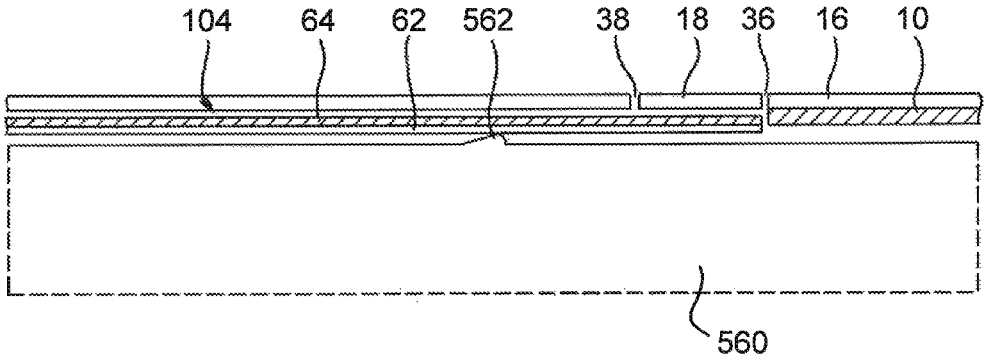
FIG. 13 is a view similar to that of FIG. 7A, illustrating the interaction between the locking edges of the container and slider, with the slider being in accordance with the embodiment of FIG. 12, and additionally showing the position of the blister pack carrier within the slider, and the action of the biasing means associated therewith.

FIG. 13 is a cross sectional view similar to that of FIG. 7A though the side of the resulting package, including a container and the slider of FIG. 12. The container is of the same type described by reference to FIG. 1. Here, the position of the blister pack obtained from the blank shown in FIG. 12 is schematically indicated. The side edge of the blister pack 560 having the projection 562 formed from projections 464,462 on the first and second panels 404, 406 forming the blister pack carrier is shown contacting the sidewall 104 of the slider to bias the double ply locking edge into engagement with the locking edge of the container provided by flap 10. The flaps defined by the flap assemblies associated with the end wall of the slider are omitted for clarity in this view.

It will be appreciated that the biasing means illustrated in FIGS. 12 and 13 may be incorporated in any of the earlier described embodiments, and may be used together or separately from any one of the other preferred features described by reference to FIG. 12 e.g. the segmented dispensing opening covers, the shorter blister slots, or the flap construction including the multiple panels and tab. The biasing means is also applicable to other types of containers in which the locking edge of the slider is not necessarily two ply.

It will be appreciated that various modifications to the above arrangements may be made within the scope of the invention. For example, the blocking panel may be attached to the second panel rather than the first panel as described. Moreover, there may be more or less dispensing openings and slots from that shown in the particular embodiments, depending on the nature of the blister pack being packaged. The shape of the dispensing openings, and any covers, or segments therefor where applicable, may be selected as desired e.g. depending upon the shape of the blister contents, and need not be of the shapes illustrated. Slots in the first panel of the blister pack carrier for accommodating blisters may be provided that are shorter than the continuous slots shown e.g. in FIG. 3, but, in contrast to FIG. 12, which are long enough to accommodate more than one blister. Further it should be understood that the various panels referred to herein may be formed from one or more sub panels. In addition it is envisaged that the slider and blister pack carrier might be provided using separate blanks attached to one another, rather than forming part of a single piece blank. The blister pack carrier may then be provided with an attachment panel to enable it to be attached to the slider. The blister pack carrier blank might then additionally include a panel to provide the end wall of the slider.

What is claimed is:

1. A package comprising:

a container having an open end and a closed end, and comprising a pair of sidewalls, at least one facing panel connecting the sidewalls, and an end wall;

a slider for holding a product, the slider being slidably mounted within the container and comprising at least one sidewall and at least one facing panel;

wherein the package comprises at least one releasable locking feature at a side of the package, the releasable locking feature comprising a pair of locking edges, one associated with a sidewall of each of the slider and container respectively, and a release area for releasing a locking abutment between the locking edges, the release area being provided in the sidewall of the container having the locking edge;

wherein the locking edges cooperate to prevent movement of the slider out of the open end of the container for permitting access to the product until a user manually applies pressure to the release area to deform the release area and thereby deflect the locking edge of the slider out of abutment with the locking edge of the container to permit the slider to slide past the locking edge of the container;

wherein the package comprises means for biasing the locking edge of the slider into engagement with the locking edge of the container; and wherein the biasing means comprises a projection which biases the locking edge of the slider into engagement with the locking edge of the container.

2. The package of claim 1, wherein the projection is a lug.

3. The package of claim 1 wherein the projection is a two ply projection.

4. The package of claim 1 wherein the slider is configured to hold a product in the form of a blister pack.

5. The package of claim 4 wherein the package further comprises a carrier for the blister pack, and a panel of the carrier is connected to the slider.

6. The package of claim 5 wherein the panel of the carrier is connected to the slider along a foldline.

7. The package of claim 5 wherein the panel of the carrier is connected to the slider at an end opposite to an end having a retaining flap for preventing complete separation of the slider and the container.

8. The package of claim 5 wherein a panel of the blister pack carrier is connected to an end wall of the slider along a foldline at a first edge of the end wall, the end wall of the slider being connected to a facing panel of the slider along a foldline at an opposed second edge of the end wall, and wherein the first and second edges of the end wall are connected by side edges of the end wall.

9. The package of claim 5 wherein the carrier comprises a first panel having an opening for movably receiving a blister of said blister pack and a second panel having one or more dispensing openings aligned with said first panel opening, the first panel and the second panel slidably receiving the blister pack therebetween; and a blocking member selectively moveable between a blocking position and a dispensing position, said blocking member in its blocking position preventing movement of said blister in said first panel opening into alignment with said dispensing opening, thereby preventing dispensing of the blister's contents through the dispensing opening, and in said dispensing position permitting said blister to be moved into alignment with said dispensing opening for dispensing the blister's contents.

10. The package of claim 5 wherein the projection projects from a side edge of the blister pack carrier.

11. The package of claim 1 wherein the container and/or slider are each made of a foldable sheet material.

12. The package of claim 1 wherein the locking edge of the slider comprises two or more plies of a material used to provide the slider.

13. A package comprising:

a container having an open end and a closed end, and comprising a pair of sidewalls, at least one facing panel connecting the sidewalls, and an end wall;

a slider for holding a product, the slider being slidably mounted within the container and comprising at least one sidewall and at least one facing panel;

wherein the package comprises at least one releasable locking feature at a side of the package, the releasable locking feature comprising a pair of locking edges, one associated with a sidewall of each of the slider and container respectively, and a release area for releasing a locking abutment between the locking edges, the release area being provided in the sidewall of the container having the locking edge;

wherein the locking edges cooperate to prevent movement of the slider out of the open end of the container for permitting access to the product until a user manually applies pressure to the release area to deform the release area and thereby deflect the locking edge of the slider out of abutment with the locking edge of the container to permit the slider to slide past the locking edge of the container;

wherein the package comprises means for biasing the locking edge of the slider into engagement with the locking edge of the container;

wherein the slider is configured to hold a product in the form of a blister pack, and the package further comprises a carrier for the blister pack, and a panel of the carrier is connected to the slider;

and wherein the biasing means comprises a projection, and wherein the projection projects from a side edge of the blister pack carrier.

14. The package of claim 13, wherein the projection is a lug.

* * * * *